US010745768B2

(12) United States Patent
Andersen et al.

(10) Patent No.: US 10,745,768 B2
(45) Date of Patent: Aug. 18, 2020

(54) APPARATUSES AND METHODS FOR STRETCHING A PELT ON A PELT BOARD

(71) Applicant: MINKPAPIR A/S, Holstebro (DK)

(72) Inventors: Mogens Fahlgren Andersen, Holstebro (DK); Soren Frolund, Holstebro (DK)

(73) Assignee: MINKPAPIR A/S, Holstebro (DK)

( * ) Notice: Subject to any disclaimer, the term of this patent is extended or adjusted under 35 U.S.C. 154(b) by 243 days.

(21) Appl. No.: 15/561,223

(22) PCT Filed: Mar. 22, 2016

(86) PCT No.: PCT/EP2016/056215
§ 371 (c)(1),
(2) Date: Sep. 25, 2017

(87) PCT Pub. No.: WO2016/150938
PCT Pub. Date: Sep. 29, 2016

(65) Prior Publication Data

US 2018/0057900 A1 Mar. 1, 2018

(30) Foreign Application Priority Data

Mar. 25, 2015 (EP) ..... 15160910
Mar. 25, 2015 (EP) ..... 15160914
(Continued)

(51) Int. Cl.
*C14B 15/06* (2006.01)
*C14B 1/26* (2006.01)

(52) U.S. Cl.
CPC ..... *C14B 15/06* (2013.01); *C14B 1/26* (2013.01)

(58) Field of Classification Search
CPC ..... C14B 15/04; C14B 15/06; C14B 1/26; C14B 17/10
(Continued)

(56) References Cited

U.S. PATENT DOCUMENTS 4,381,654 A 5/1983 Baldridge
4,787,221 A * 11/1988 Johansson ..... C14B 1/26 69/40
(Continued)

FOREIGN PATENT DOCUMENTS

DK 169525 11/1994
DK 200001174 2/2002
(Continued)

OTHER PUBLICATIONS

International Search Report on corresponding PCT application (PCT/EP2016/056215) from International Searching Authority (EPO) dated Jun. 13, 2016.
(Continued)

*Primary Examiner* — Jameson D Collier
*Assistant Examiner* — Heather N Mangine
(74) *Attorney, Agent, or Firm* — Klein, O'Neill & Singh, LLP

(57) ABSTRACT

A stretching apparatus for stretching a pelt on a pelt board, wherein the pelt has a substantially tubular shape defining an inwardly oriented leather side, an outwardly oriented fur side, a nose end, a rear end and a pair of front leg cavities. The pelt board defines a top end for accommodating and fixating the nose end of the pelt, a circumferential wall for facing the inwardly oriented leather side of the pelt and a base end located opposite the top end. The stretching apparatus comprises a holding device for holding the base end of the pelt board, and a stretching device having a pair of stretching members. Each of the stretching members are adapted in order to be inserted into a respective front leg cavity of the pelt and the stretching device is movable in a direction towards the holding device for stretching the pelt.

10 Claims, 27 Drawing Sheets

(30) Foreign Application Priority Data

| | | |
|---|---|---|
| Mar. 25, 2015 | (EP) | 15160917 |
| Aug. 10, 2015 | (EP) | 15180350 |
| Aug. 27, 2015 | (EP) | 15182654 |
| Dec. 4, 2015 | (EP) | 15197981 |
| Dec. 15, 2015 | (EP) | 15200164 |

(58) Field of Classification Search
USPC ..... 69/19.2, 19, 19.1
See application file for complete search history.

(56) References Cited

U.S. PATENT DOCUMENTS

| | | | | |
|---|---|---|---|---|
| 4,945,736 | A | 8/1990 | Lagori et al. | |
| 6,915,669 | B2 * | 7/2005 | Hedegaard | C14B 1/26 69/19.3 |
| 7,900,488 | B2 | 3/2011 | Hedegaard | |
| 2003/0019255 | A1 * | 1/2003 | Hedegaard | C14B 15/06 69/22 |
| 2004/0060330 | A1 | 4/2004 | Hedegaard | |
| 2007/0028655 | A1 * | 2/2007 | Hedegaard | C14B 1/26 69/21 |
| 2009/0007604 | A1 * | 1/2009 | Hedegaard | C14B 1/58 69/19.3 |
| 2009/0019898 | A1 * | 1/2009 | Hedegaard | B61B 13/04 69/22 |
| 2011/0041568 | A1 * | 2/2011 | Sindersen | C14B 1/58 69/23 |
| 2014/0007627 | A1 * | 1/2014 | Pedersen | C14B 15/06 69/22 |
| 2014/0373577 | A1 * | 12/2014 | Frolund | C14B 15/06 69/21 |
| 2016/0160300 | A1 | 6/2016 | Pedersen | |

FOREIGN PATENT DOCUMENTS

| | | | |
|---|---|---|---|
| DK | 200001836 | 6/2002 | |
| DK | 176683 | 2/2009 | |
| DK | 177012 | 12/2010 | |
| DK | 177149 | 2/2012 | |
| EP | 1440171 | 9/2006 | |
| EP | 1485507 | 11/2010 | |
| EP | 1678331 | 12/2010 | |
| EP | 2818563 | 12/2014 | |
| EP | 2913410 | 9/2015 | |
| EP | 3176271 | 6/2017 | |
| EP | 3415645 A1 * | 12/2018 | C14B 15/06 |
| WO | WO2002044428 | 6/2002 | |
| WO | WO2005028682 | 3/2005 | |
| WO | WO2005080607 | 9/2005 | |
| WO | WO2006026986 | 3/2006 | |
| WO | WO2007033681 | 3/2007 | |
| WO | WO2008022644 | 2/2008 | |
| WO | WO2008025364 | 3/2008 | |
| WO | WO2012126467 | 9/2012 | |
| WO | WO2015003919 | 1/2015 | |
| WO | WO2015024788 | 2/2015 | |

OTHER PUBLICATIONS

Written Opinion on corresponding PCT application (PCT/ EP2016/056215) from International Searching Authority (EPO) dated Jun. 13, 2016.

International Search Report on corresponding PCT application (PCT/EP2017/054901) from International Searching Authority (EPO) dated Jun. 12, 2017.

Written Opinion on corresponding PCT application (PCT/ EP2017/054901) from International Searching Authority (EPO) dated Jun. 12, 2017.

International Search Report on related PCT application (PCT/ EP2018/067318) from International Searching Authority (EPO) dated Aug. 14, 2018.

Written Opinion on related PCT application (PCT/ EP2018/067318) from International Searching Authority (EPO) dated Aug. 14, 2018.

Non-Final Office Action on co-pending U.S. Application (U.S. Appl. No. 16/080,485) dated Mar. 23, 2020.

* cited by examiner

APPARATUSES AND METHODS FOR STRETCHING A PELT ON A PELT BOARD

FEDERALLY SPONSORED RESEARCH OR DEVELOPMENT

Not Applicable

CROSS-REFERENCE TO RELATED APPLICATIONS

This application is the national phase entry, under 35 U.S.C. Section 371(c), of International Application No. PCT/EP2016/056215, filed Mar. 22, 2016, claiming priority from European Application Nos. 15160914.6, filed Mar. 25, 2015, 15160910.4, filed Mar. 25, 2015, 15160917.9, filed Mar. 25, 2015, 15180350.9, filed Aug. 10, 2015, 15182654.2, filed Aug. 27, 2015, 15197981.2, filed Dec. 4, 2015, and 15200164.0, filed Dec. 15, 2015. The disclosures of the International Application and the European Applications from which this application claims priority are incorporated herein by reference in their entireties.

The present invention relates to apparatuses and methods for stretching a pelt on a pelt board

BACKGROUND OF THE INVENTION

In the fur industry, animal pelts are often stretched in a non-destructive way in order to maximize the size of the pelt. The pelts define a substantially tubular shape and have an outwardly oriented fur side and an inwardly oriented leather side. The stretching is taking place after skinning the animal and scraping off the layer of fat on the leather side of the pelt and before the drying of the pelt. In the present context, the word pelt is understood to encompass pelts of minks, foxes and similar small mammals. The pelts are often stretched on a pelt board, which is nowadays made of plastic. Normally, the leather side of the pelt is facing the surface of the pelt board and the pelt board may in addition be provided with a fat absorbing material such as a paper bag or sleeve, which is in contact with the leather side of the pelt. The fur side of the pelt is thereby facing outwardly during the stretching and drying of the pelt.

The stretching procedure and the use of pelt boards are known per se and both are disclosed in e.g. WO 2005/028682 A1. Therein is disclosed the use of a gripping element which is brought in engagement with the whole periphery of the pelt and the drawing of a fixing bag over the outside of the pelt in order to maintain the pelt in a stretched configuration during the drying of the pelt. Thereby, the previous use of staples and the thus produced elongated holes in the pelts may be avoided.

In relation to the above terminology, the word bag which in its normal understanding may describe a sleeve with a closed off bottom should in the present circumstances and further along in the present patent application be understood to also encompass sleeves which are not closed off and which have a tubular or cylindrical shape without a closed off bottom.

WO 2006/026986 A1 discloses a help arrangement for clamping the nose end of a pelt to a pelt board.

WO 2007/033681 A2 discloses a method and machine for the folding out of the tail part of the pelt in connection with the stretching of the pelt on the pelt board.

WO 2008/025364 A1 relates to a method and machine for performing water brushing of tanned pelts in order to achieve a more presentable appearance of the pelt.

WO 02/44428 A1 relates to another method and machine for stretching of a pelt on a pelt board. The pelt is secured in the stretched positing by means of a sleeve or bag which is drawn over and around the pelt board, so that the pelt is pressed and locked against the pelt board. This method, which is also described above, is nowadays used as standard method for fixing the pelt in the stretched position in a non-damaging way.

DK 169 525 B1 discloses a machine for stretching a pelt. The machine includes a gripping mechanism for holding the pelt. Magnetic sensors are used for controlling the extent of stretching of the pelt by the gripping mechanism.

DK 2000 01174 L discloses another method in which the stretched pelt is held in place in a non-destructive way by the use of a pelt bag or sleeve.

EP 2 818 563 A1 discloses a hair controller for mounting on a stretching machine. The controller utilizes a nozzle or orifice for providing a stream of air.

US 2003/0019255 A1 discloses yet another method for fastening a pelt on a pelt board after stretching by the use of a sleeve or bag, and a corresponding sleeve for use with the method.

WO 2008/022644 A1 discloses a tube-shaped holding bag, which is drawn over the fur side of the pelt for holding the pelt in a stretched position.

WO2005/080607 discloses a method and an apparatus for fastening a fur on a pelt board by the use of a stretchable wrapping foil supplied from a single foil reel.

WO 2012/126467 discloses a technique of determining the maximum force to which a pelt may be exposed by measuring the initial lengths of the pelt prior to applying a stretch force to the pelt and predicting the maximum allowable force to be applied to the pelt from the initial length.

WO 2015/024788 discloses an apparatus and a method for stretching a pelt according to which method and in which apparatus the speed with which the pelt is stretched is gradually reduced during the stretching of the pelt.

It has been realized that by stretching of the pelt according to the above prior art technologies by gripping the lower end of the pelt, i.e. the tail end of the pelt, most of the stretching force is applied to the lower part of the pelt, i.e. the part of the pelt closest to the tail end of the pelt, and less force is applied to the upper part of the pelt, i.e. the part of the pelt which is closest to the nose part of the pelt. This is contrary to the anatomy of the pelt since the upper part of the pelt would normally be capable of withstanding a larger force than the lower part of the pelt. The pelt will thus not be stretched in an optimal way by applying the stretching force to the lower part of the pelt. It is thus an object according to the present invention to provide technologies for properly stretching of both the upper part of the pelt as well as the lower part of the pelt.

Further, in connection with the stretching of the lower part of the pelt it has been realized that placing the pelt board including the pelt in a proper stretching position is difficult due to the fact that the gripping mechanism, which is intended to fasten the pelt about its complete contour, i.e. both the back side contour and leg side contour, obstructs the access of the user. Thus, it is an object according to the present invention to provide technologies for simplifying the access of the user to the stretching apparatus.

Yet further, it has been realized that the stretching operation and in particular the fine tuning of the gripping mechanisms require the user to hold one hand on the pelt while the other hand is operating the user interface of the stretching apparatus. This is disadvantageous in relation to the alignment of the pelt in the stretching apparatus and it would be advantageous if the user could be able to use two hands holding the pelt instead of only one hand. Thus, it is an object according to the present invention to provide technologies for allowing the user to operate the stretching apparatus while keeping both hands on the pelt.

Still further, it has been realized that the wrapping operation performed by using a single stretchable wrapping foil is suffering from serious drawbacks, in particular in relation to the speed of the operation and the physical impact on the pelt board and the fixation of the pelt board by stretching the wrapping foil during the wrapping operation. Thus, it is an object of the present invention to provide technologies for allowing an improved fixation of the pelt relative to the pelt board in relation to speed and fixation strength as compared to the prior art single foil wrapping technology.

Still further, it has been realized that the non-symmetrical structure of a pelt, in particular a pelt from a mink or similar skinned animal is inhomogeneous and for this reason, the difference in strength of the pelt when exposing the pelt to the stretching operation may cause bending of the pelt board, which in the first place exposes the pelt board to excessive forces and in addition, may cause an incorrect stretching of the pelt, which incorrect stretching does not establish the intended shift of the length from one class to another.

Still further, it has been realized that the stretching of the pelt may advantageously be combined with a fur processing step such as a step of brushing the fur side of the pelt, using rollers for properly orientating the hair of the pelt, or a comb for orientating the hair of the pelt in an intentional and proper orientation prior to or after the stretching of the pelt by using the pelt stretching apparatus.

SUMMARY OF THE INVENTION

At least the above object or at least one of numerous further objects, which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the pelt and a base end located opposite the top end, the stretching apparatus comprising:

- a holding device for holding the base end of the pelt board, and
- a stretching device having a pair of stretching members, each of the stretching members being adapted for being inserted into a respective front leg cavity of the pelt, the stretching device being movable in a direction towards the holding device for stretching the pelt.

The pelt, the pelt board and how the pelt is mounted on the pelt board, have been described in detail above. The front leg cavities arise in the pelt after skinning and cutting off the paws of the animal. The front leg cavities may comprise smaller tubular pelt parts which originally covered the front legs of the animal and which are normally inverted and folded inwardly to be positioned between the leather side of the pelt and the pelt board in order for these parts to be dried out as well. On the outside of the pelt when mounted on the pelt board, cavities thus appear which have been designated front leg cavities.

The holding device is holding the base end of the pelt board in a fixated position and preferably in a vertical orientation such that the pelt board extends upwardly from the holding device and consequently, the pelt extends on the pelt board from a rear end adjacent the holding device to a nose end pointing upwardly and away from the holding device.

The pair of stretching members of the stretching device may be inserted into a respective front leg cavity and thus at least partially enter the leg portion of the pelt which as explained above has been inverted. By moving the stretching member towards the holding device, typically downwardly, the pelt will be stretched since the stretching members will cause the leg cavities to move along with the stretching members, thereby inducing a stretching force onto the upper part of the pelt, i.e. the part of the pelt being closest to the nose end. Thereby the pelt may be stretched in a non-destructive way without needing to fasten any part of the pelt and allowing air to still access all parts of the leather side of the pelt. Typical forces involved are about 100-150N for achieving a proper non-destructive stretching of the upper part of the pelt.

According to a further embodiment of the above aspect, the stretching members comprise cylindrical pins. Such cylindrical pins will be advantageous for entering the leg cavities and applying the stretching force in a non-destructive way.

According to a further embodiment of the above aspect, the apparatus comprises a first fastening device for fastening the rear end of the pelt, the first fastening device being movable in a direction towards the holding device for stretching the pelt. Preferably, also the lower end of the pelt is stretched simultaneously with the upper part of the pelt. The stretching of the lower part of the pelt may be performed according to the prior art or as will be described further below. Generally, the rear end, of the pelt is fastened to a fastening device which is then moved in a direction towards the holding device, i.e. generally downwardly. The fastening device should fasten the pelt along its complete contour and not only the tail and rear legs, since otherwise the non fastened parts of the contour of the lower end will not be stretched and may on the contrary be contracted, yielding a lower price for the pelt.

According to a further embodiment of the above aspect, the apparatus comprises a second fastening device for fastening a tail part extending from the rear end of the pelt, the second fastening device being movable in a direction towards the holding device for stretching the pelt. It may in addition to the above be advantageous to stretch the tail part since the tail forms part of a very dense connective tissue which extends from the tail part along the back side of the pelt to the nose part, which tissue may be capable of withstanding a larger stretching force.

According to a further embodiment of the above aspect, the apparatus comprises a third fastening device for fastening and fixating the nose end of the pelt, the third fastening device being movable in a direction towards the holding device for stretching the pelt. Optionally, the nose end may be fixated and moved in a direction away from the holding device, i.e. typically upwardly. Since the stretching force is applied to the pelt board, the rigidness of the pelt board sets a final limit on the amount of stretching which may be applied to the pelt, since a too large stretching force will cause the pelt board to bend and any additional stretching will not stretch the pelt but further bend the pelt board. To avoid this and relieve the stress on the pelt board, the nose end may be moved in the opposite direction of the stretching force, thereby relieving the pelt board and allowing a higher total stretching force.

According to a further embodiment of the above aspect, the stretching device, the first fastening device and/or the second fastening device and/or the third fastening device is/are movable by means of a pneumatic drive, a hydraulic drive or a spindle drive. The above drive mechanisms may be used for an efficient and accurate stretching to be performed.

According to a further embodiment of the above aspect, the first fastening device and/or the second fastening device comprise opposing gripping members for gripping the pelt between the inwardly oriented leather side and the outwardly oriented fur side. In order to achieve a firm fastening of the rear end of the pelt, the pelt is preferably gripped between opposing gripping members.

According to a further embodiment of the above aspect, the holding device, the stretching device, the first fastening device, the second fastening device and/or the third fastening device comprise one or more vibration actuators for inducing one or more oscillations onto the pelt. By vibrating the pelt at the same time as it is being stretched, i.e. inducing an oscillating movement into the pelt, the fibers in the pelt tissue may additionally loosen in a non-destructive way allowing the pelt to be stretched further than by just applying the stretching force in a single direction.

According to a further embodiment of the above aspect, the vibration actuator will be operating at a frequency of between 1 Hz and 100 Hz. Such frequencies will be advantageous for obtaining the above effect.

According to a further embodiment of the above aspect, the stretching device, the first fastening device, the second fastening device and/or the third fastening device comprise a compressed air outlet for temporarily removing any fur hair located adjacent the compressed air outlet. By allowing a stream of compressed air to be directed toward the area of the pelt which will be fastened by the stretching device and/or fastening device where present, the area of contact between these devices and thereby the area of the pelt at which the stretching force is applied will be free from hair and thus the hair originally covering these areas will remain essentially unaffected and undamaged by the stretching.

According to a further embodiment of the above aspect, the stretching apparatus further comprises a holding bag applicator. The holding bag may be applied automatically onto the pelt board after the stretching has been completed by the use of a holding bag applicator.

According to a further embodiment of the above aspect, the base end of the pelt board comprises a connecting element and the holding device comprises a locking part for locking the connecting element to the holding device. Thereby the pelt board remains in a substantially fixated and upright position during stretching and the risk of bending the pelt board during stretching is thereby reduced.

According to a further embodiment of the above aspect, the pair of stretching members is interconnected by a rack and pinion actuator. In this way, the stretching members may be adapted to different widths between the front leg cavities for different pelts.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the pelt and a base end located opposite the top end, the pelt further defining a contour constituting a leg side contour and a back side contour, the stretching apparatus comprising:

a holding device for holding the base end of the pelt board, the stretching apparatus defining a pelt board space extending outwardly along a longitudinal direction from the holding device for accommodating the pelt board, a stretching device having a pair of stretching members, each of the stretching members being adapted for being inserted into a respective front leg cavity of the pelt, the stretching device being movable in a direction towards the holding device for stretching the pelt, and a fastening device, the fastening device comprising a first gripping mechanism for fastening the rear end of the pelt along either the back side contour or the leg side contour, and a second gripping mechanism for fastening the rear end of the pelt along either the leg side contour or the back side contour, respectively, the first gripping mechanism and the second gripping mechanism being movable in the longitudinal direction and the second gripping mechanism additionally being movable between a first position, in which the first gripping mechanism and the second gripping mechanism are located on the same side of the pelt board space, and a second position, in which the first gripping mechanism and the second gripping mechanism are located on opposite sides of the pelt board space.

The above aspect is preferably used for achieving a complete stretching of both the upper part and the lower part of the pelt.

At least the above object or at least one of numerous further objects, which will be evident from the below description of the present invention, is according to one aspect of the present invention obtained by a method of stretching a pelt on a pelt board comprising performing the steps of:

providing the pelt and the pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the pelt and a base end located opposite the top end, providing a stretching apparatus comprising a holding device and a stretching device, the stretching device having a pair of stretching members, holding the base end of a pelt board by the holding device, inserting each of the stretching members of the stretching device into a respective front leg cavity of the pelt, and moving the stretching device in a direction towards the holding device, thereby stretching the pelt.

The above method is preferably used together with the above apparatuses.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the pelt further defining a contour constituting a leg side contour and a back side contour, the stretching apparatus comprising:

a holding device for holding the base end of the pelt board, the stretching apparatus defining a pelt board space extending outwardly along a longitudinal direction from the holding device for accommodating the pelt board, and a fastening device, the fastening device comprising a first gripping mechanism for fastening the rear end of the pelt along either the back side contour or the leg side contour, and a second gripping mechanism for fastening the rear end of the pelt along either the leg side contour or the back side contour, respectively, the first gripping mechanism and the second gripping mechanism being movable in the longitudinal direction and the second gripping mechanism additionally being movable between a first position, in which the first gripping mechanism and the second gripping mechanism are located on the same side of the pelt board space, and a second position, in which the first gripping mechanism and the second gripping mechanism are located on opposite sides of the pelt board space.

The pelt and the pelt board have been described in detail above. The pelt has a substantially tubular shape having four leg parts on a leg side and a back side opposite the leg side. The pelt defines a rear end which is understood to be the part of the pelt where the tail part and the rear leg parts are located. The contour of the pelt is in the present context understood to constitute the circumference of the pelt, which is divided into a leg side contour and a back side contour, each constituting approximately a half part of the full contour.

The holding device is holding the base end of the pelt board in a fixated position and preferably in a vertical orientation such that the pelt board extends upwardly from the holding device and consequently, the pelt extends on the pelt board from a rear end adjacent the holding device to a nose end pointing upwardly and away from the holding device. The holding device thus defines a pelt board space in the stretching apparatus which should be unobstructed for allowing the pelt board to be fitted correctly.

The first gripping mechanism fixates the rear end of the pelt along any one of the leg side contour or the back side contour, preferably the back side contour. Thereby it is preferable that the complete half part of the contour is fixated by the first gripping mechanism for achieving a uniform stretching of the pelt. The first gripping mechanism is preferably located spaced apart from the user. The first and the second gripping mechanisms are movable synchronously in a longitudinal direction by means of a driving mechanism located behind the first gripping mechanism in order to adjust the position of the gripping mechanisms and for performing the stretching.

The second gripping mechanism is movable between a first position constituting a mounting position which is used for simplifying the placement of the pelt board in the holding device and simplifying the accessing of the pelt board's space, and a second position which is a stretching position which is used when the apparatus is stretching the pelt. In the first position, the second gripping mechanism is located behind the pelt board space and preferably beside the first gripping mechanism allowing the user to freely access the pelt board space for placing the pelt board in the correct position. In the second position, the second gripping mechanism is located on the opposite side of the pelt board space such that the pelt board when mounted in the holding device is located between the first gripping mechanism and the second gripping mechanism.

When the first gripping mechanism has been fastened to the rear end of the pelt, the second gripping mechanism is moved from the first position to the second position and thereafter the second gripping mechanism is fastened to the rear end of the pelt along the contour which is not already fixated by the first gripping mechanism, preferably being the leg side contour. Thereafter the stretching of the pelt is initiated.

According to a further embodiment of the above aspect, the first gripping mechanism is fastening the rear end of the pelt along the back side contour and the second gripping mechanism is fastening the rear end of the pelt along the leg side contour. Preferably, the pelt board leg side is facing the user during the fixation.

According to a further embodiment of the above aspect, the first gripping mechanism and/or the second gripping mechanism comprise a gripping element and an opposite holding element, the gripping element being movable in relation to the holding element in order to pin the rear end of the pelt between the gripping element and the holding element. Preferably, the pelt is pinned between the gripping element and the holding element which are movable to pin the pelt between the fur side and the leather side.

According to a further embodiment of the above aspect, the second gripping mechanism comprises a first half part and a second half part, each half part being adapted for gripping approximately a quarter of the contour. Each half part may be moved separately between the first position and the second position.

According to a further embodiment of the above aspect, when in the first position, the first half part and a second half part are located on opposite sides of the pelt board space.

Thus, the first half part and the second half part are located on opposite sides of the first gripping mechanism when in the first position.

According to a further embodiment of the above aspect, the movement between the first position and the second position involves a linear movement and a rotational movement of the second gripping mechanism. Preferably, the second mechanism when moved from the first position to the second position is first pulled forward and then rotated to face the pelt board in the pelt board space in the second position. After mounting and stretching, the procedure is reversed before the pelt board is removed.

According to a further embodiment of the above aspect, the holding device and/or the fastening device comprise a vibration actuator for inducing an oscillation onto the pelt. By vibrating the pelt at the same time as it is being stretched, i.e. inducing an oscillating movement into the pelt, the fibers in the pelt tissue may additionally loosen in a nondestructive way allowing the pelt to be stretched further than by just applying the stretching force in a single direction.

According to a further embodiment of the above aspect, the vibration actuator operates at a frequency of between 1 Hz and 100 Hz. Such frequencies will be advantageous for obtaining the above effect.

According to a further embodiment of the above aspect, the stretching apparatus further comprises a holding bag applicator. The holding bag may be applied automatically onto the pelt board after the stretching has been completed by the use of a holding bag applicator.

According to a further embodiment of the above aspect, the base end of the pelt board comprises a connecting element and the holding device comprises a locking part for locking the connecting element to the holding device. Thereby the pelt board remains in a substantially fixated and upright position during stretching and the risk of bending the pelt board during stretching is thereby reduced.

According to a further embodiment of the above aspect, the fastening device comprises a compressed air outlet for temporarily removing any fur hair located adjacent the compressed air outlet. By allowing a stream of compressed air to be directed toward the area of the pelt which will be fastened by the stretching device and/or fastening device, where present, the area of contact between these devices and thereby the area of the pelt at which the stretching force is applied will be free from hair and thus the hair originally covering these areas will remain essentially unaffected and undamaged by the stretching.

According to a further embodiment of the above aspect, the holding device and/or the fastening device is/are movable by means of a pneumatic drive, a hydraulic drive or a spindle drive. The above drive mechanisms may be used for an efficient and accurate stretching to be performed.

According to a further embodiment of the above aspect, the fastening device comprises a laser for generating a visual alignment line on the pelt. In this way, the positioning of the pelt will be simplified as the user will be aided in the alignment of the pelt. The correct positioning is critical for achieving a correct stretching of the pelt and avoid any misalignment of the pelt caused by bad positioning of the pelt in the fastening mechanism.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end, a rear end and a pair of front leg cavities, the pelt board defining a top end for accommodating and fixating the nose end of the pelt, a circumferential wall for facing the inwardly oriented leather side of the of the pelt and a base end located opposite the top end, the pelt further defining a contour constituting a leg side contour and a back side contour, the stretching apparatus comprising:

- a holding device for holding the base end of the pelt board, the stretching apparatus defining a pelt board space extending outwardly along a longitudinal direction from the holding device for accommodating the pelt board,
- a stretching device having a pair of stretching members, each of the stretching members being adapted for being inserted into a respective front leg cavity of the pelt, the stretching device being movable in a direction towards the holding device for stretching the pelt, and
- a fastening device, the fastening device comprising a first gripping mechanism for fastening the rear end of the pelt along either the back side contour or the leg side contour, and a second gripping mechanism for fastening the rear end of the pelt along either the leg side contour or the back side contour, respectively, the first gripping mechanism and the second gripping mechanism being movable in the longitudinal direction and the second gripping mechanism additionally being movable between a first position in which the first gripping mechanism and the second gripping mechanism are located on the same side of the pelt board space, and a second position in which the first gripping mechanism and the second gripping mechanism are located on opposite sides of the pelt board space.

The above aspect is preferably used for achieving a complete stretching of both the upper part and the lower part of the pelt.

At least the above object or at least one of numerous further objects which will be evident from the below description of the present invention, is according to one aspect of the present invention obtained by a method of stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the pelt further defining a contour constituting a leg side contour and a back side contour, the method comprising the steps of:

- providing a stretching apparatus comprising a holding device and a fastening device, the fastening device comprise a first gripping mechanism and a second gripping mechanism,
- holding the base end of a pelt board by the holding device so that the pelt board extends outwardly along a longitudinal direction from the holding device,
- moving the first gripping mechanism and the second gripping mechanism along the longitudinal direction,
- fastening the rear end of the pelt along either the back side contour or the leg side contour by using the first gripping mechanism,
- moving the second gripping mechanism from an initial first position in which the first gripping mechanism and the second gripping mechanism are located on the same side of the pelt board to a second position in which the first gripping mechanism and the second gripping mechanism are located on opposite sides of the pelt board, and
- fastening the rear end of the pelt along either the leg side contour or the back side contour, respectively.

The above method is preferably used with the above apparatuses.

At least the above object or at least one of numerous further objects which will be evident from the below description of the present invention, is according to one aspect of the present invention obtained by a stretching apparatus for stretching a pelt on a pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, the stretching apparatus comprising:

- a holding device for holding the base end of the pelt board, and
- a fastening device comprising a gripping mechanism for fastening the rear end of the pelt, the fastening device further comprising a drive mechanism for moving the first fastening device relative to the holding device and for positioning the rear end of the pelt within the gripping mechanism, the gripping mechanism being controlled by a first user interface and the drive mechanism being controlled by a second user interface, the first user interface and/or the second user interface being located a distance of less than 30 cm from the gripping mechanism.

The pelt and the pelt board have been described in detail above. The holding device is holding the base end of the pelt board in a fixated position and preferably in a vertical orientation such that the pelt board extends upwardly from the holding device and consequently the pelt extends on the pelt board from a rear end adjacent the holding device to a nose end pointing upwardly and away from the holding device. The gripping mechanism fixates the rear end of the pelt along its contour between the fur side of the pelt and the leather side of the pelt. It is thereby important that the complete tubular contour of the pelt is fixated as the pelt otherwise may be skewed during stretching.

The gripping mechanism thus comprises two distinct states, namely a fixated state where the gripping mechanism is fixating the rear end of the pelt, and a non-fixated state where the pelt is loose relative to the gripping mechanism. In order for the pelt to be put into the correct position, the gripping mechanism is initially in the loose state allowing the user to insert the rear end of the pelt between gripping members of the gripping mechanism. The user may fine tune the position by hand and by moving the complete fastening device including the gripping device towards or away from the holding device by using the drive mechanism, the user may position the rear end of the pelt in the correct longitudinal position.

The gripping mechanism is controlled by a first user interface and the drive mechanism is controlled by a second user interface, which both should be positioned such that the user may operate both the user interfaces while still keeping the hands on the pelt for ensuring that the correct alignment of the rear end of the pelt is kept while the user is changing the position of the fastening device by using the same hands. This may be achieved by locating both the user interfaces a distance of less than 30 cm from the gripping mechanism.

In this way the user may hold both hands on the rear end of the pelt and simultaneously adjust the gripping mechanism to the correct position and fasten the pelt to the gripping mechanism while maintaining both hands on the pelt.

According to a further embodiment of the above aspect, the first user interface and/or the second user interface is located less than 30 cm from the gripping mechanism, preferably less than 20 cm, more preferably less than 10 cm, most preferably less than 5 cm. More advantageously, the first user interface, the second user interface or both user interfaces are located even closer to the gripping mechanism, such as the distances indicated above.

According to a further embodiment of the above aspect, the first user interface and/or the second user interface comprises a proximity sensor, such as a photo detector or an IR sensor. Preferably, touch or contact free interfaces are used, which eliminates the need of the user to actuate a button or the like with the limited capabilities of moving the hand which the user has when already holding the rear end of the pelt and attempting to position it in the correct position relative to the gripping mechanism.

According to a further embodiment of the above aspect, the first user interface and/or the second user interface comprises a pressure sensor, a resistive sensor or a capacitive sensor. Alternatively, a touch sensor is used. In this way unintentional activation of the sensor may be avoided.

According to a further embodiment of the above aspect, the second user interface comprises a first sensor for causing the drive mechanism to move the fastening device away from the holding device, and a second sensor for causing the drive mechanism to move the fastening device towards the holding device. The second user interface is preferably split into two separate sensors for controlling individually the two different directions of the drive mechanism. The two sensors are preferably located on opposite sides of the gripping mechanism such that each sensor may be maneuvered by a separate hand.

According to a further embodiment of the above aspect, the distance between the gripping mechanism and the holding mechanism is unobstructed and/or the stretching apparatus enables a human user to simultaneously reach both the gripping mechanism and the holding mechanism by the same hand. Preferably, the user interfaces are positioned without any obstructions between the user interfaces and the gripping mechanism in order to improve the user's ability to reach the user interfaces while manipulating the rear end of the pelt.

According to a further embodiment of the above aspect, the holding device and/or the fastening device comprises a vibration actuator for inducing an oscillation onto the pelt. By vibrating the pelt at the same time as it is being stretched, i.e. inducing an oscillating movement into the pelt, the fibers in the pelt tissue may additionally loosen in a nondestructive way allowing the pelt to be stretched further that by just applying the stretching force in a single direction.

According to a further embodiment of the above aspect, the vibration actuator operates at a frequency of between 1 Hz and 100 Hz. Such frequencies will be advantageous for obtaining the above effect.

According to a further embodiment of the above aspect, the stretching apparatus further comprises a holding bag applicator. The holding bag may be applied automatically onto the pelt board after the stretching has been completed by the use of a holding bag applicator.

According to a further embodiment of the above aspect, the base end of the pelt board comprises a connecting element and the holding device comprises a locking part for locking the connecting element to the holding device. Thereby the pelt board remains in a substantially fixated and upright position during stretching and the risk of bending the pelt board during stretching is thereby reduced.

According to a further embodiment of the above aspect, the fastening device comprises a compressed air outlet for temporarily removing any fur hair located adjacent the compressed air outlet. By allowing a stream of compressed air to be directed toward the area of the pelt which will be fastened by the stretching device and/or fastening device where present, the area of contact between these devices and thereby the area of the pelt at which the stretching force is applied will be free from hair and thus the hair originally covering these areas will remain essentially unaffected and undamaged by the stretching.

According to a further embodiment of the above aspect, the holding device and/or the fastening device is movable by means of a pneumatic drive, a hydraulic drive, an electric drive or a spindle drive. The above drive mechanisms may be used for an efficient and accurate stretching to be performed.

According to a further embodiment of the above aspect, the fastening device comprises a laser for generating a visual alignment line on the pelt. In this way the positioning of the pelt will be simplified as the user will be aided in the alignment of the pelt. The correct positioning is critical for achieving a correct stretching of the pelt and avoids any misalignment of the pelt caused by incorrect positioning of the pelt in the fastening mechanism.

According to a further embodiment of the above aspect, the fastening device comprises opposing gripping members for gripping the pelt between the inwardly oriented leather side and the outwardly oriented fur side. The gripping members initially assume the nonfixated position when the rear end of the pelt is inserted between the gripping members and the drive mechanism is used for positioning the gripping mechanism at the rear end of the pelt. The fixated position is used when the rear end of the pelt if fixated between the opposing gripping element for stretching the pelt.

At least the above object or at least one of numerous further objects which will be evident from the below description of the present invention, is according to one aspect of the present invention obtained by a method of stretching a pelt on a pelt board comprising performing the steps of:

providing the pelt and the pelt board, the pelt having a substantially tubular shape defining an inwardly oriented leather side, an outwardly oriented fur side, a nose end and a rear end, the pelt board defining a top end for accommodating and fixating the nose end of the pelt, a circumferential wall for facing the inwardly oriented leather side of the of the pelt and a base end located opposite the top end, providing a stretching apparatus comprising a holding device and a fastening device, the fastening device comprising a gripping mechanism and a drive mechanism, providing a first user interface for controlling the gripping mechanism and a second user interface for controlling the drive mechanism, the first user interface and/or the second user interface being located a distance of less than 30 cm from the gripping mechanism, holding the base end of a pelt board by the holding device, moving the first fastening device relative to the holding device and for positioning the rear end of the pelt within the gripping mechanism by using the second user interface, operating the gripping mechanism by using the first user interface.

The above method may advantageously be used together with the above apparatus.

Further aspects according to the present invention includes stretching assemblies comprising combinations of pelt boards and a stretching apparatuses as described according to any of the above aspects.

At least one of the above objects or at least one of numerous further objects, which will be evident from the below description of the present invention, is according to a further aspect of the present invention obtained by a an apparatus for fixating a pelt to a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said pelt and a base end located opposite to said top end, said apparatus comprising:

a holding device for receiving said base end of said pelt board and holding said pelt board, a fastening device having a pair of and preferably two pairs of gripping members for gripping and arresting said pelt relative to said pelt board by gripping and fastening said rear end of said pelt relative to said pelt board, and a wrapping device including at least two foil wrapping units for wrapping foil round said pelt at said rear end of said pelt for fixating said pelt to said pelt board, said at least two foil wrapping units being positioned so as to apply said wrapping foils to said pelt from positions causing the pull from each of said foils to be equalized by the pull of the other foil or the other foils.

In accordance with the teachings of the present invention, it has been realized that the speed of wrapping foils round a pelt positioned on a pelt board may be increased by the use of several, at least two foils rather than a single foil. Apart from the increase in speed by use of multiple wrapping foils rather than a single wrapping foil, the use of the multiple wrapping foils according to the teachings of the present invention allows for an increased stretching force to be applied to the pelt board without causing the pelt board to be shifted or dislocated relative to the holding device, as the two or more wrapping foils are according to the teachings of the present invention applied so as to equalize the pulls from the wrapping foils and in doing so, expose no pull force at all or no substantial pull force to the pelt board while performing the wrapping operation. Consequently, by the use of the pull force equalizing concept according to the present invention, the fixating of the pelt board relative to the apparatus need not to involve a rigid connection, rather allows a simple resting of the pelt board in the holding device and in addition, reduces the physical impact to the pelt board itself while wrapping the wrapping foils round the rear end of the pelt.

According to alternative embodiments of the apparatus according to the further aspects of the present invention, the two foil wrapping units are positioned at opposite sides of the pelt board and symmetrically relative to the pelt board for applying the wrapping foils from opposite sides of the pelt board. Alternatively, three or more foil wrapping units may be used, provided the multiple wrapping foil units are positioned at the same angular mutual distance as the foil wrapping units may be present in a number n and the angular spacing between any two adjacent wrapping foil units being 360°/n. The use of three foil wrapping units allows for the use of three individual wrapping foils, which evidently reduces the wrapping application time needed, and also provides a highly advantageous 120° spacing in itself well known from other technical fields.

The wrapping of the multiple wrapping foils round the rear end of the pelt may be carried out in accordance with two alternative variants, the one involving rotating the wrapping units relative to the pelt board or around the pelt board, or alternatively may be carried out by rotating the pelt board as the pelt board may be positioned at the center of an imaginary circle, on which the wrapping units are located. It is contemplated that the use of a rotating pelt board rotated relative to stationary wrapping units is particularly advantageous provided the number of wrapping units exceeds two units as the complexity of performing the wrapping operation is evidently reduced by the simple rotating of the pelt board and keeping the wrapping unit stationary as compared to the inverse wrapping unit rotation setup.

In accordance with a further aspect of the present invention, a method of fixating a pelt to a pelt board is provided, which method comprises a method of fixating a pelt to a pelt board comprising performing the steps of:

providing said pelt and said pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said pelt and a base end located opposite to said top end, providing an apparatus comprising a holding device, a fastening device and a wrapping device, said holding device serving to receive said base end of said pelt board and holding said pelt board, said fastening device having a pair of and preferably two pairs of gripping members for gripping and arresting said pelt relative to said pelt board by gripping and fastening said rear end of said pelt relative to said pelt board, said wrapping device including at least two foil wrapping units for wrapping foil round said pelt at said rear end of said pelt, the method further comprising:

positioning said pelt board in said holder, fastening said pelt relative to said pelt board by means of said pair or preferably two pairs of gripping members after stretching said pelt on said pelt board and wrapping foils from said at least two foil wrapping units round said pelt at said rear end of said pelt for fixating said pelt to said pelt board and in doing so, applying said wrapping foils to said pelt from positions causing the pull from each of said foils to be equalized by the pull of the other foil or other foils.

At least one of the numerous further objects and/or the above objects together with one or more of the numerous further objects, which will be evident from the below description of the present invention, is according to a further aspect invention obtained by a stretching apparatus for stretching a pelt on a pelt board, said pelt having a substantially tubular shape defining an inwardly oriented leather side, an outwardly oriented fur side, a nose end, a rear end and a back piece including a tendinous ligament, said pelt board defining a top end for accommodating and fixating said nose end of said pelt, a circumferential wall for facing said inwardly oriented leather side of said of said pelt and a base end located opposite said top end, said stretching apparatus comprising:

a holding device for holding said base end of said pelt board, a fastening device for fastening said rear end of said pelt and being movable relative to said holding device for stretching said pelt, and an arresting and supporting device for arresting and supporting said top end of said pelt board for preventing said tendinous ligament to cause said pelt board to bend when stretching said pelt.

According to the basic teachings of the present invention, it has been realized that the tendinous ligament of a pelt, in particular the pelt of a mink causes a high strength resistance to the stretching of the pelt and in doing so, may cause a bending of the pelt board, which bending is, according to the teachings of the present invention, prevented by the arresting and supporting device according to the present invention serving to prevent or at least reduce the backward bending of the pelt board as in this context, backward is referring to the back piece of the pelt.

In accordance with different embodiments of the stretching apparatus according to the present invention, an alternative embodiment of the arresting and supporting device is constituted by an arm having an arm end part for catching said top end of said pelt board.

A further alternative embodiment of the arresting and supporting device includes a ringshaped end part for circumferentially enclosing and supporting said pelt board at said nose end of said pelt when stretching said pelt.

Another further alternative embodiment of the arresting and supporting device includes a cup-shaped end part for enclosing said nose end of said pelt at said top end of said pelt board.

At least one of the numerous further objects and/or the above objects together with one or more of the numerous further objects, which will be evident from the below description of the present invention, is according to a further aspect invention obtained by a method of stretching a pelt on a pelt board comprising the steps of:

providing said pelt on said pelt board, said pelt having a substantially tubular shape defining an inwardly oriented leather side and an outwardly oriented fur side, a nose end, a rear end and a back piece including a tendinous ligament, said pelt board defining a top end for accommodating and fixating said nose of said pelt, a circumferential wall for facing said inwardly oriented leather side of said pelt and a base end located opposite said top end, providing a stretching apparatus comprising a holding device, a fastening device and an arresting and supporting device, said holding device serving to hold said base end of said pelt board, said fastening device to fasten said rear end of said pelt, said arresting and supporting device serving to support said top end of said pelt board for preventing said tendinous ligament to cause said pelt board to bend when stretching said pelt, positioning said pelt on said pelt board, positioning said pelt board in said holding device prior to or after arranging said pelt on said pelt board, fastening said fastening device to said rear end of said pelt, moving said fastening device relative to said holding device for stretching said pelt and in doing so, supporting said top end of said pelt board by means of said arresting and supporting device.

At least one of the numerous further objects and/or the above objects together with one or more of the numerous further objects, which will be evident from the below description of the present invention, is according to a further aspect of the present invention obtained by a stretching apparatus for stretching a pelt on a pelt board, said pelt having a substantially tubular shape defining an inwardly oriented leather side, an outwardly oriented fur side, a nose end, a rear end and a back piece including a tendinous ligament, said pelt board defining a top end for accommodating and fixating said nose end of said pelt, a circumferential wall for facing said inwardly oriented leather side of said of said pelt and a base end located opposite said top end, said stretching apparatus comprising:

a holding device for holding said base end of said pelt board, a fastening device for fastening said rear end of said pelt and being movable relative to said holding device for stretching said pelt, and a fur side processing tool being supported movably relative to said pelt board along said first side from a nose end positioned to a rear end position and to be returned from said rear end position to said nose end position.

According to the basic teachings of the present invention, it has been realized that the proper stretching and the proper production of a high quality pelt may involve the steps of processing the fur side of the pelt by using a roller, a brush or a comb for orienting the hair of the pelt in a proper orientation prior to the step of drying the pelt after the pelt has been stretched on the stretching apparatus. It is to be realized that the processing of the fur side of the pelt may be accomplished prior to or after the stretching operation as such.

According to the presently preferred embodiment of the stretching apparatus according to the present invention, the apparatus further comprises a vertical stand supporting the holding device supporting said holding device, said fastening device and said fur side processing tool, said fur side processing tool being journaled vertically movable relative to said stand.

According to advantageous embodiments of the stretching apparatus according to the present invention, the fur side processing tool includes agitator elements, such as rollers, brushes, combs or other elements for contacting the fur side of the pelt, and the agitator elements may advantageously be powered by a motor for incurring a mechanical processing of the fur side of the pelt.

According to the presently preferred embodiment of the stretching apparatus according to the present invention, the first side processing tool being positioned circumferentially encircling said pelt board.

At least one of the numerous further objects and/or the above objects together with one or more of the numerous further objects, which will be evident from the below description of the present invention, is according to a further aspect invention obtained by a method of stretching a pelt on a pelt board comprising the steps of:

providing set pelt on said pelt board, said pelt having a substantially tubular shape defining an inwardly oriented leather side and an outwardly oriented fur side, a nose end, a rear end and a back piece including a tendinous ligament, said pelt board defining a top end for accommodating and fixating said nose of said pelt, a circumferential wall for facing said inwardly oriented leather side of said pelt and a base end located opposite said top end, providing a stretching apparatus comprising a holding device, a fastening device and a fur side processing tool, said holding device serving to hold said base end of said pelt board, said fastening device to fasten said rear end of said pelt, said fur side processing tool being supported movable relative to said pelt board, positioning said pelt on said pelt board, positioning said pelt board in said holding device prior to or after arranging said pelt on said pelt board, fastening said fastening device to said rear end of said pelt, moving said fastening device relative to said holding device for stretching said pelt and prior to or after said stretching of said pelt, moving said fur side processing tool along the fur side of said pelt from a nose end position to a rear end position and returning said processing tool from said rear end position to said nose end position.

The techniques of fixating a pelt relative to a pelt board may be combined with the above described techniques of stretching a pelt as the wrapping apparatus may be combined into a combined stretching and wrapping apparatus as will be evident from the below detailed description of a presently preferred embodiment of the apparatus and method according to the present invention.

The techniques of stretching a pelt by preventing backward bending of a pelt board according to the teachings of the present invention may, as will be readily understood, be combined with the above described techniques of fixating a pelt relative to a pelt board and stretching a pelt, as the arresting and supporting device of the stretching apparatus according to the present invention may readily be provided with a combined stretching and wrapping apparatus, as will be evident from the below detailed description of advantageous embodiments of the apparatus and the method according to the present invention.

The basic technique of stretching a pelt by the use of an apparatus for stretching the pelt and performing a method of stretching the pelt has been the subject of numerous investigations including investigations made by the applicant company. The investigations have as such resulted in the creation or the generation of diagrammatic representation of the correspondence between the force applied to a pelt and the increase of the length or the actual length of the pelt obtained by stretching the pelt by the application of the force in question. As stated above, numerous suggestions have been presented as being safe predictions of the maximum force to which the pelt may be exposed as according to the teaching of WO 2012/126467 a prediction is made from the initial length of the pelt according to a linear relation. The experiments made by the applicant company, however, have revealed that apart from the force applied, the force gradient, i.e. the increase in force per incremental length increase, is more important as to determining the safe maximum force to which the pelt may be exposed before tearing apart the pelt. In addition, the experiments made by the applicant company have revealed that for a specific species, for instance male or female mink, the stretching may be performed until a safe force value is reached, which safe force value may be determined constituting a force to which the pelt may readily be exposed without running any substantive risk of tearing apart the pelt since the ability of the pelt due to its elastic properties allows for a larger force impact than the safe initial force or force gradient to which the pelt may be exposed.

In accordance with the above realization, the method according to the present invention is characterized in that the method of stretching a pelt on a pelt board comprises performing the steps of:

i) providing said pelt and said pelt board, said pelt having a substantially tubular shape defining an inwardly oriented leather side, an outwardly oriented fur side, a nose end, a rear end and a pair of front leg cavities, said pelt board defining a top end, a circumferential wall for facing said inwardly oriented leather side of said pelt and a base end located opposite said top end, ii) providing a stretching apparatus comprising a holding device, a fixating device, a length measuring device, and a controllable actuator having a velocity controller and a force detector, iii) holding said base end of said pelt board by said holding device, iv) positioning said pelt on said pelt board by arranging said nose end of said pelt in contact with said top end and arranging said rear end of said pelt at said base end, v) contacting said fixating device with said pelt at said rear end thereof, vi) operating said controllable actuator at a specific speed controlled by said velocity controller for causing said holding device and said fixating device to be moved relative to one another and away from one another and in doing so stretching said pelt while detecting by means of said force detector the force applied to said pelt by said controllable actuator, vii) measuring the length of said pelt by means of said length measuring device at the time a specific force constituting an empirically determined safe force has been detected or a specific force gradient constituting an empirically determined safe force gradient has been detected, and viii) registering said length and said specific force and/or said specific force gradient as a first set of coherent data.

As stated above the empirically determined safe force and the determined safe force gradient constitute entities to which the pelt of the species in question may readily be exposed and from the point of initially exposing the pelt to the preset specific force or force gradient, measurements are to be performed for determining to which extent the pelt may further stretch. Consequently, according to the presently advantageous embodiment of the present invention, the method of stretching a pelt on a pelt board further comprises the additional steps of ix) while continuing step vi) measuring the incremental increase of the length of said pelt measured by said length measuring device, x) measuring the force value by means of said force detector applied to said pelt for creating said incremental increase of the length of said pelt, xi) determining on the basis of the force value measured in step x) and the incremental increase of the length measured in step ix), the force gradient needed for creating the incremental increase of the length of the pelt, and xii) registering the incremental increase of the length of said pelt and/or the total length of said pelt and the force measured in step x) and/or the force gradient determined in step xi) as a second set of coherent data.

The registering of the coherent data constituted by the increase of the length of the pelt and/or the total length of the pelt and the force applied or preferably the force gradient applied allows for the determination of the safe maximum force gradient and consequently the maximum force which the pelt may be exposed to, consequently, the method according to the present invention further comprises:

continuing repeating the steps ix)-xi) until a pre-set maximum allowable force or a pre-set maximum allowable force gradient has been reached and discontinuing operating said controllable actuator in step vi).

The registering of the coherent data constituting the first set and also the second set allows for a self-learning procedure to be carried out as the data registered for several pelts of a specific species allows the forecast to be improved by the recording or registering of the data and in doing so making the data reliable as to the determination of the safe force and safe force gradient and furthermore, and possibly more importantly, the maximum allowable force or maximum allowable force gradient to which the pelt may be exposed without causing deterioration or tearing apart the pelt. It is further to be realised that the improved breeding techniques when raising species, in particular the costly, minks from which mink pelts are produced, constantly increases the length of the pelt of the minks, for which reason the learning operation of registering the coherent data described above produces a more reliable and up-to-date forecast for the stretching of the pelt of the species in question. The forecast may readily be accomplished simply from the daily use of the stretching apparatus rather than from extensive and extremely costly experiments.

In the field of raising minks and selling pelts from minks, and international standard is established by the company Kopenhagen Fur A/S, which standard classifies the pelts in length increments of 6 cm for which reason the actual determination of the maximum limit to which the pelt in question may be stretched is to be determined based on the classification of the pelts as the stretching has to reach the maximum class corresponding to the non-exceeding maximum limit of the lengths obtainable. Consequently, according to the highly relevant commercial implementation of the method according to the present invention, the method being used for stretching a pelt of a male or female mink, the length of which is to be classified according to the international classification established by Kopenhagen Fur A/S, the method further comprising the step of comparing the lengths measured in step ix) with a specific class of said pelt and on the basis of the forecasts determining whether or not further stretching of the pelt may be performed safely for reaching a further class or no further stretching is to be applied.

In accordance with a different aspect of the present invention, it is contemplated that a further increased and safe stretching may be obtained by performing the steps ix-xi in an intermittent operation, i.e. by performing the repeated stretching in steps and allowing the pelt after stretching to a specific limit to rest until further stretching is performed.

Additionally, according to alternative embodiments of the present invention, which embodiments are for the time being not considered to be highly advantageous, the velocity with which the actuator is driven may be reduced or alternatively increased.

The techniques of processing the fur side of the pelt prior to or after the stretching of the pelt by use of the stretching apparatus has proven to be highly advantageous as to the obtainment of a high quality pelt after the stretching and drying of the pelt. It is, however, to be realized that this fur processing technique may be combined with other techniques and e.g. be combined with a wrapping apparatus as will be evident from the below detailed description of advantageous embodiments of the apparatus and the method according to the present invention.

BRIEF DESCRIPTION OF THE DRAWINGS

FIG. 10 is a perspective view of the pelt board and a stretching apparatus.

FIGS. 13A and 13B are views illustrating the addition of a fur side processing tool to the stretching apparatus according to the present invention.

DETAILED DESCRIPTION OF THE DRAWINGS

Figure 1A:
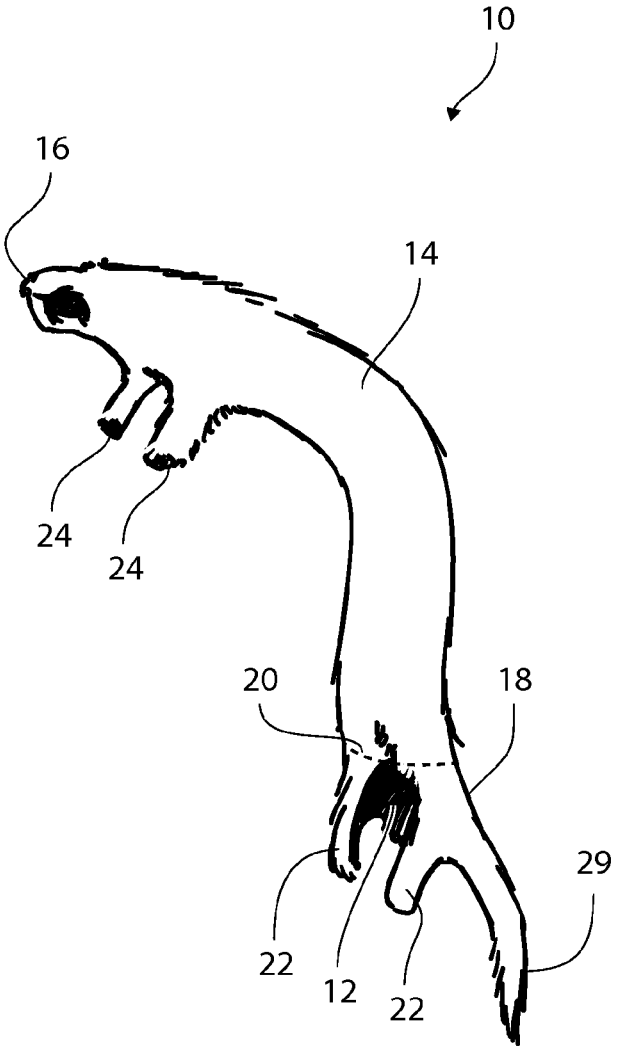
FIG. 1A is a perspective view of a pelt.

FIG. 1A shows a perspective view of a pelt 10. The pelt 10 shown here is of a mink, however, it will be anatomically similar for other small furred mammals such as fox etc. The pelt 10 has a tubular shape and comprises an inwardly oriented leather side 12, an outwardly oriented fur side 14, a nose end 16 and a rear end 18. The rear end 18 defines a contour 20 along the circumference of the tubular pelt 10. The contour 20 may be divided into a leg side contour onto which the rear legs 22 of the pelt is attached and a back side contour onto which a tail part 29 of the pelt 10 is attached.

Figure 1B:
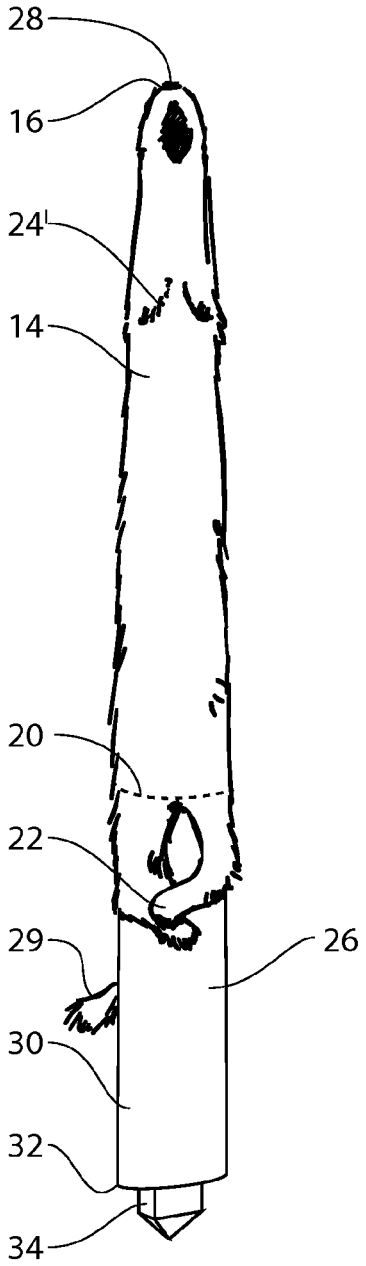
FIG. 1B is a perspective view of the pelt when mounted on a pelt board.

FIG. 1B shows a perspective view of the pelt 10 when mounted on a pelt board. The pelt 20 is mounted on the pelt board 26 such that a top end 28 of the pelt board 26 is accommodating and fixating the nose end 16 of the pelt 10 and the inwardly oriented leather side 12 of the pelt 10 is facing a circumferential wall 30 of the pelt board 26. The pelt board 26 extends in a longitudinal direction from a base end 32 to the top end 28. The base end 32 may be provided with a connecting element 34. The front leg parts have been inverted and are accommodated between the pelt 10 and the pelt board 26, thereby establishing a pair of front leg cavities 24' of the pelt 10 between the nose end 16 and the rear end 18. The pelt board 26 may typically be provided with a fat absorbing and preferably also water absorbing paper (not shown) between the circumferential wall 30 and the inwardly oriented leather side 12.

Figure 1C:
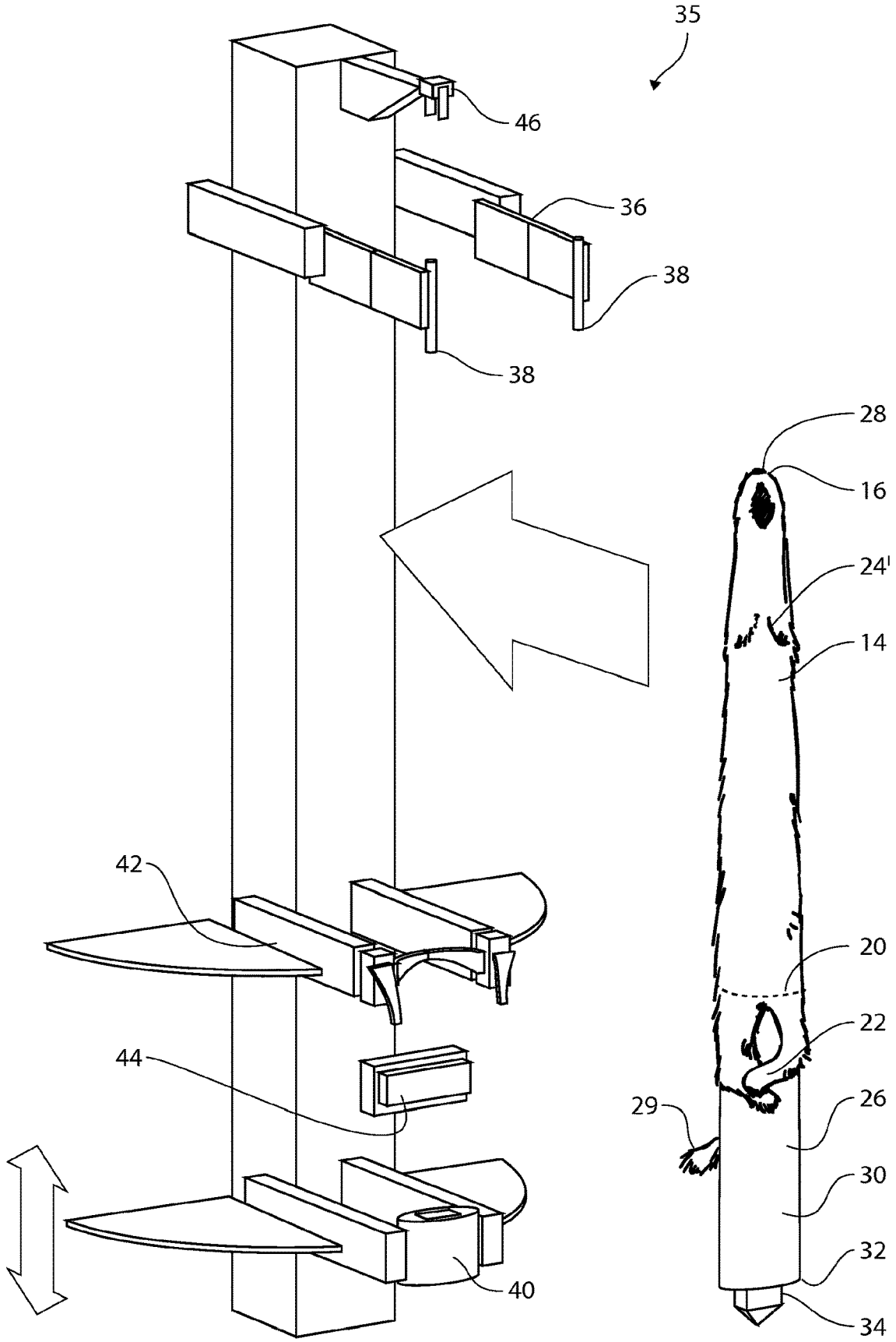
FIG. 1D is a perspective view of the stretching assembly when the pelt is mounted.
FIG. 1E is a perspective view of the stretching assembly when the stretching starts.
FIG. 1F is a perspective view of the stretching assembly and of an adapter.

FIG. 1C shows a perspective view of a stretching assembly comprising a pelt board 26 and a stretching apparatus 35. During use, the pelt board 26 is provided with a pelt 10 as described above. The stretching apparatus 35 comprises a stretching device 36 for stretching the upper part of the pelt defined between the nose end 16 and the front leg cavities 24'. The stretching device 36 comprise a pair of cylindrical stretching members 38 which are adapted to be inserted into the front leg cavities 24'.

The stretching apparatus 35 additionally comprises a holding device 40 adapted for holding the base end 32 of the pelt board 26 by fixating the connecting element 34 such that the pelt board 26 extends in a longitudinal direction in the stretching apparatus 35. The stretching apparatus 35 further comprises a first fastening mechanism 42 for fastening the rear end 18 of the pelt 10 along the contour 20, a second fastening mechanism 44 for fastening the tail end 29 of the pelt 10, and a third fastening mechanism 46 for fastening the nose end 16 of the pelt 10. The first fastening mechanism 42 is used for stretching the lower part of the pelt 10 extending between the front leg cavities 24' and the rear end 18 of the pelt. At least the second fastening mechanism 44 and the third fastening mechanism 46 are considered to be optional in the present setup.

Figure 1D:
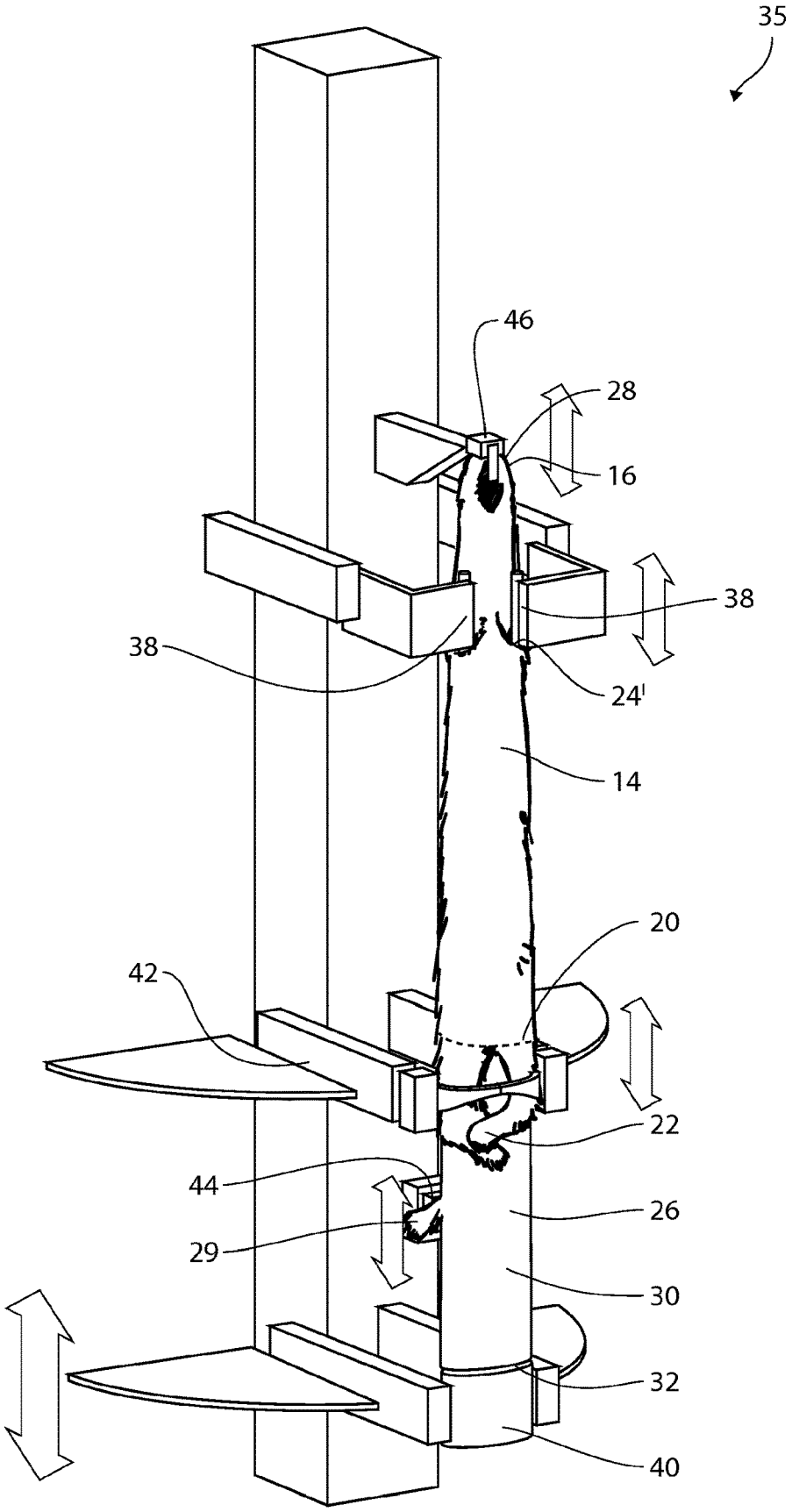

FIG. 1D shows a perspective view of a stretching assembly when the pelt 10 has been mounted. All of the holding device 40, stretching device 36, first fastening mechanism 42, second fastening mechanism 44 and third fastening mechanism 46 are movable along the longitudinal direction defined by the pelt board 26 in order to adapt the stretching apparatus 35 to different pelt boards 26 and different pelts 10. This is shown by the arrows.

Figure 1E:
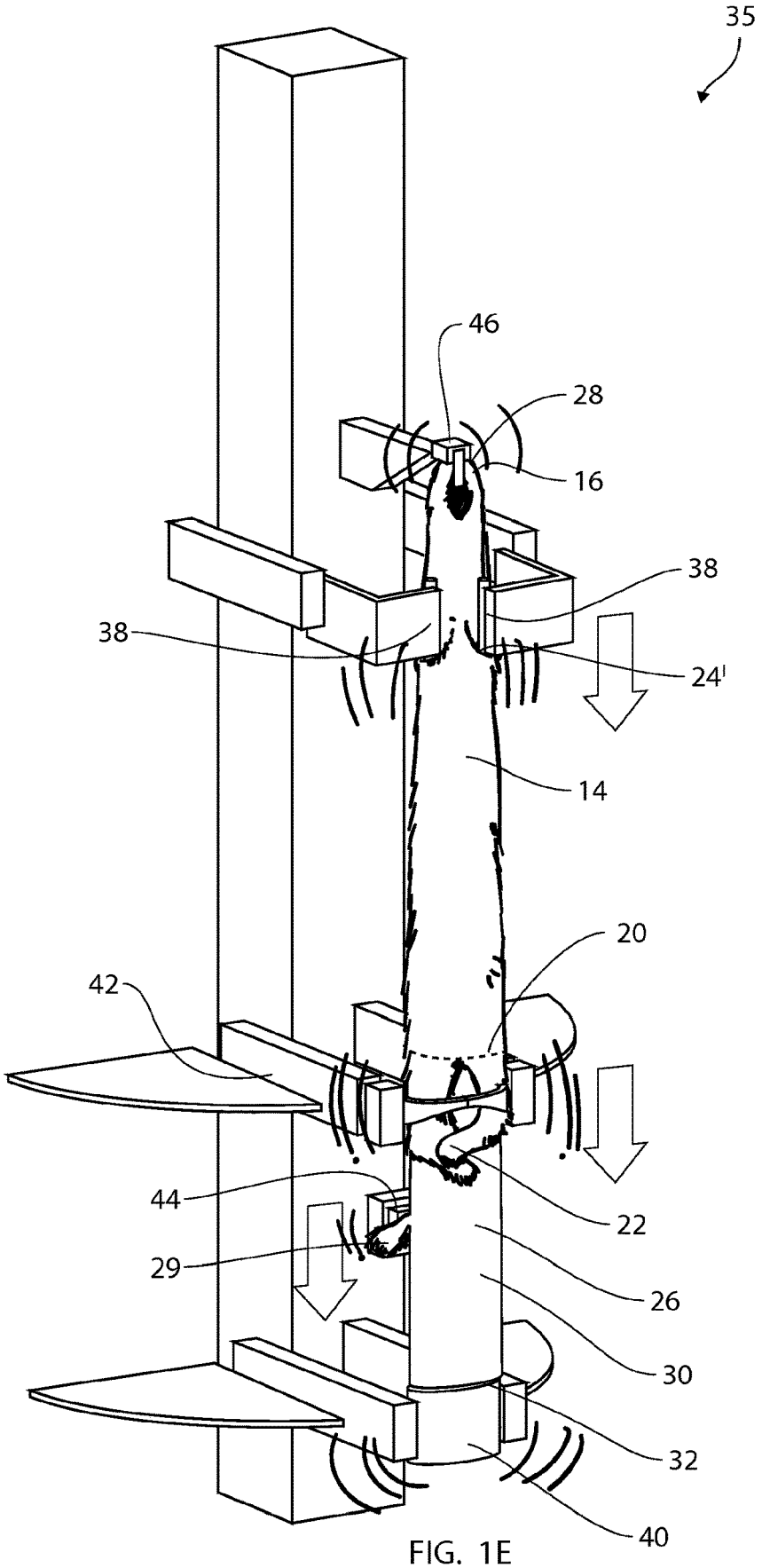

FIG. 1E shows a perspective view of a stretching assembly when the stretching of the pelt 10 starts. The pelt 10 is thereby stretched by causing the stretching device 36, first fastening mechanism 42 and second fastening mechanism 44 to move toward the holding device 40 by means of appropriate drive mechanisms which will be discussed further below. The third fastening mechanism 46 may be caused to move in the opposite direction for relieving the pelt board 26 of pressure. The forces involved for each of the stretching device 36, first fastening mechanism 42, second fastening mechanism 44 and third fastening mechanism 46 are typically in the range of 100-200N. The forces may be applied at a steady magnitude, or alternatively a vibration or oscillation is induced in the pelt, or yet alternatively a combination of the above where e.g. a time period of oscillations are followed by a steady stretching force in order to first loosed the fibers of the pelt 10 and thereafter stretching the fibers of the pelt 10.

Figure 1F:
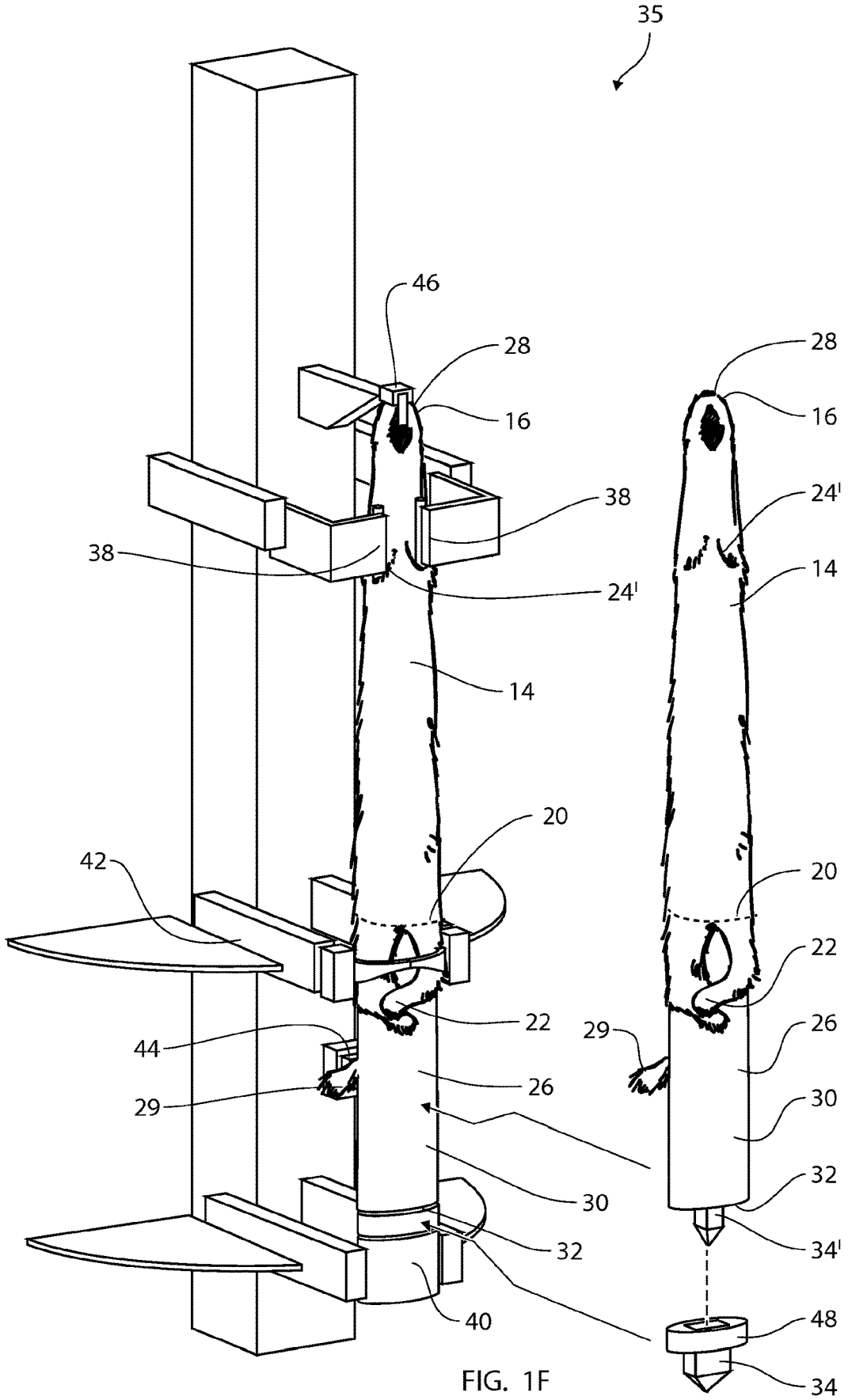

FIG. 1F shows a perspective view of a stretching assembly and the optional provision of an adapter 48 which is used for allowing pelt boards 26 having a different sized connecting element 34' to be used in the present stretching assembly 34. The adapter 48 is thereby connected to the different sized connecting element 34' whereby the adapter is provided with the proper sized connecting element 34 for use with the holding device 40 of the stretching apparatus 35.

Figure 2A:
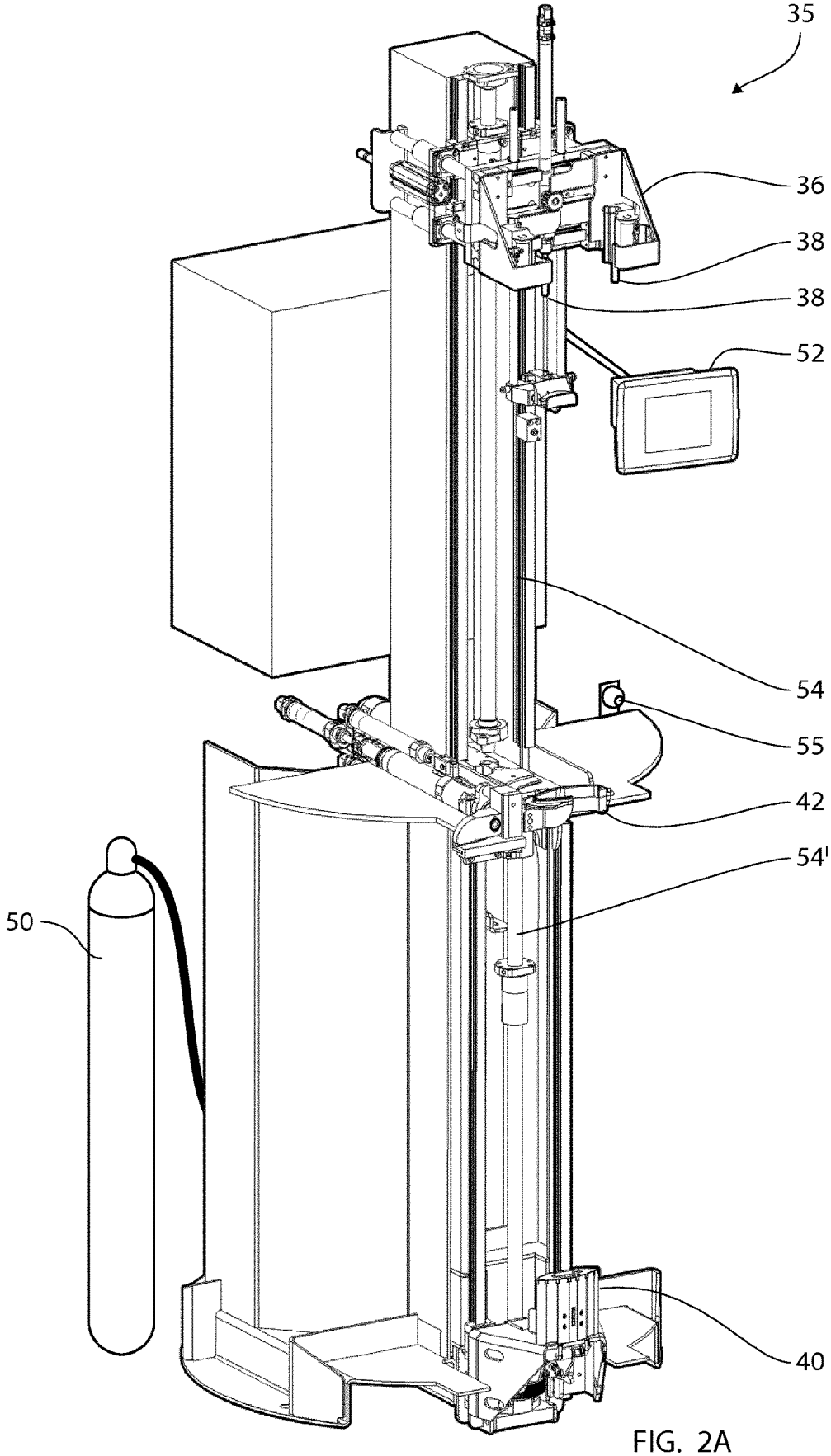
FIG. 2A is a perspective view of a mechanical setup of the stretching apparatus

FIG. 2A shows a perspective view of the mechanical setup of the stretching apparatus 35. The stretching apparatus 35 comprises a compressed air source 50 and a display 52. The stretching device 36 is driven pneumatically and movable by use of compressed air from the compressed air source 50. The holding device 40 and the first fastening device 42 are mechanically driven by spindle drives 54' and 54, respectively. It is thereby understood that various combinations of drives may be used for the stretching device 36, the holding device 40, the first fastening mechanism 42, the second fastening mechanism 44 and the third fastening mechanism 46.

There is also provided a user interface in the form of a photo detector 55 which is located in close proximity relative to the first fastening device 42 for controlling the fixation and non-fixation positions of the first fastening device 42 while still keeping the hands of the user in contact with the pelt. The photo detector 55 may be replaced by a similar proximity sensor or a detector using other touch free or touch technologies.

Figure 2B:
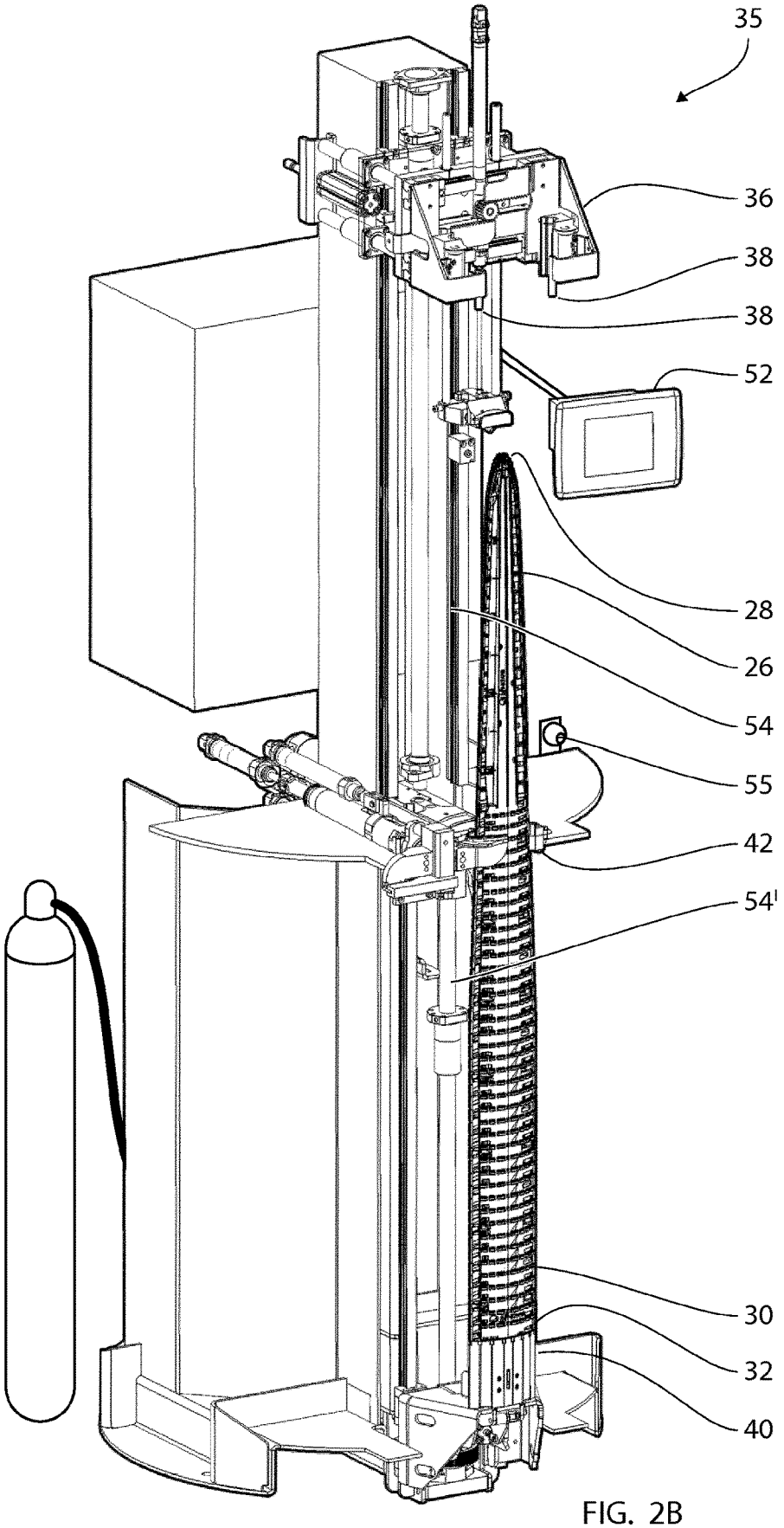
FIG. 2B is a perspective view of the stretching assembly and the pelt board.

FIG. 2B shows an perspective view of the stretching assembly wherein the pelt board 26 is placed in the correct position in the stretching apparatus 35.

Figure 3A:
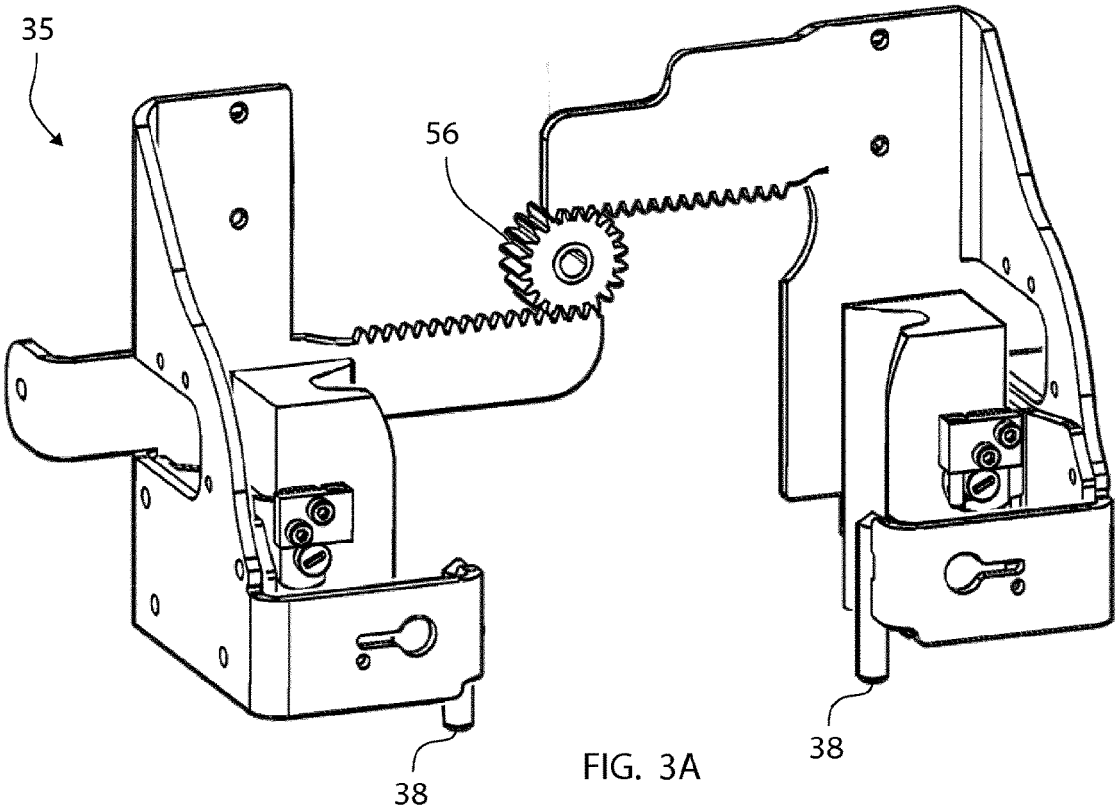
FIG. 3A is a close up view of the stretching device and the rack and pinion actuator.

FIG. 3A shows a close up view of the stretching device 35. The stretching members 38 are interconnected by a rack and pinion actuator 56. This allows the stretching members 38 to move relative to each other to adapt to different sized of pelts 10 having different distances between their front legs.

Figure 3B:
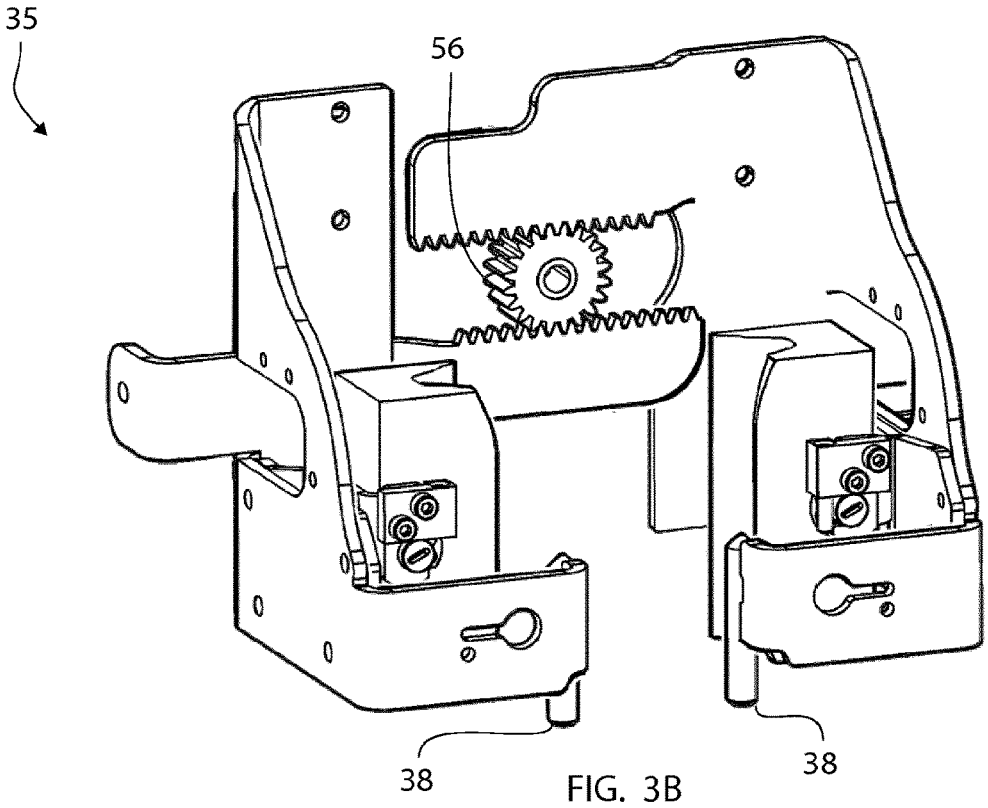
FIG. 3B is a close up view of the device when the rack and pinion actuator is adjusted.

FIG. 3B shows a close up view of the stretching device 35. The stretching members 38 have moved towards each other by means of the rack and pinion actuator 56 in order to adapt to a smaller pelt 10 i.e. having a smaller distance between the front legs.

Figure 4:
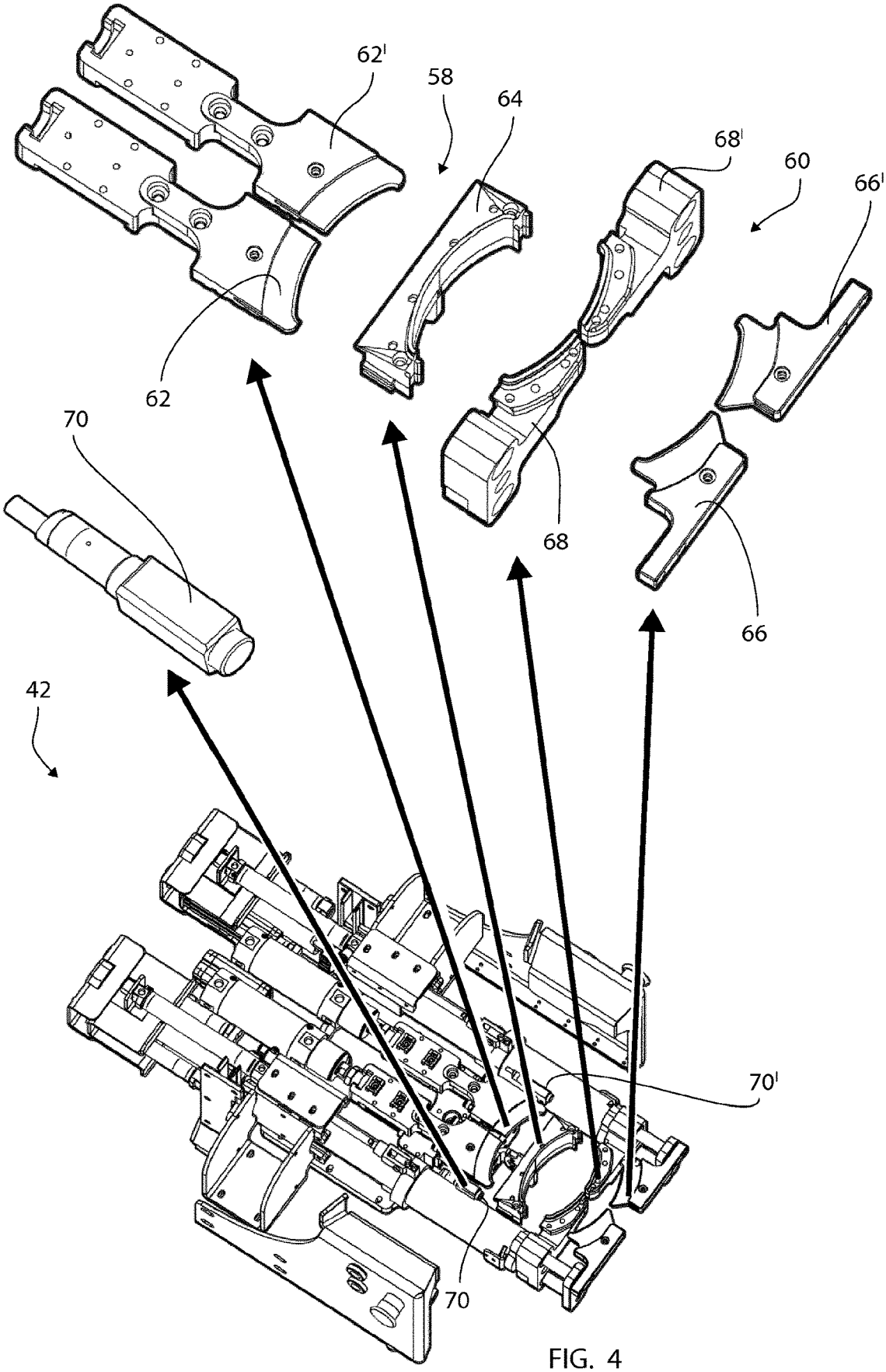
FIG. 4 is a close up view of the first fastening device.

FIG. 4 shows a close up view of the first fastening device 42. The first fastening device 42 comprises a first gripping element 58 for fastening the rear end of the pelt along the back side contour, and a second gripping element 60 for fastening the rear end of the pelt along the leg side contour. The first gripping element 58 comprises a pair of first gripping elements 62 and 62' which are movable in relation to a first holding element 64 for fasten the rear end of the pelt along the back side contour between the gripping elements 62 and 62' and the holding element 64. The holding element 64 may be movable in order to adapt to the pelt board. The second gripping element 60 comprises a pair of second gripping elements 66 and 66' which are movable in relation to a pair of second holding element 68 and 68' for fastening the rear end of the pelt along the leg side contour between the gripping elements 66 and 66' and the holding elements 68 and 68'. The above gripping or non-gripping operations are performed in a transversal direction in relation to the longitudinal direction defined by the pelt board.

While the gripping or non-gripping operations of the first fastening device 42 are controlled by the above mentioned photo detector, there is further provided a pair of additional photo detectors 70 in close proximity to the first fastening device 42 which are operating as a user interface for the drive mechanism in order to move the fastening device in the longitudinal direction of the pelt board.

Figure 5A:
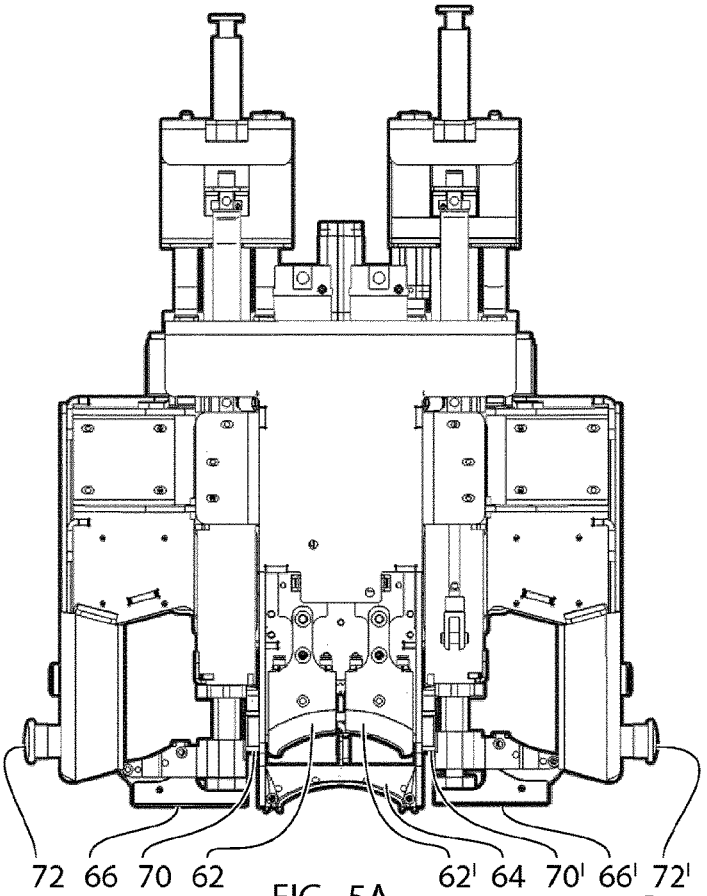
FIG. 5A is a close up view of the first fastening device when in the first position.

FIG. 5A shows a close up view of the first fastening device 42 when in the first position, which is a mounting position of the first gripping mechanism 58. The second gripping mechanism 60 is thereby folded into a non-use position. One of the set of second gripping element 66 and holding element 68 is folded to one side of the first gripping mechanism 58 whereas the other set of second gripping element 66' and holding element 68' are folded to the opposite side of the first gripping mechanism 58. In the present illustrations the pelt board has been removed. It is, however, understood that the pelt board is present in the pelt board space in front of the first gripping mechanism 58 then the stretching apparatus is in use.

Figure 5B:
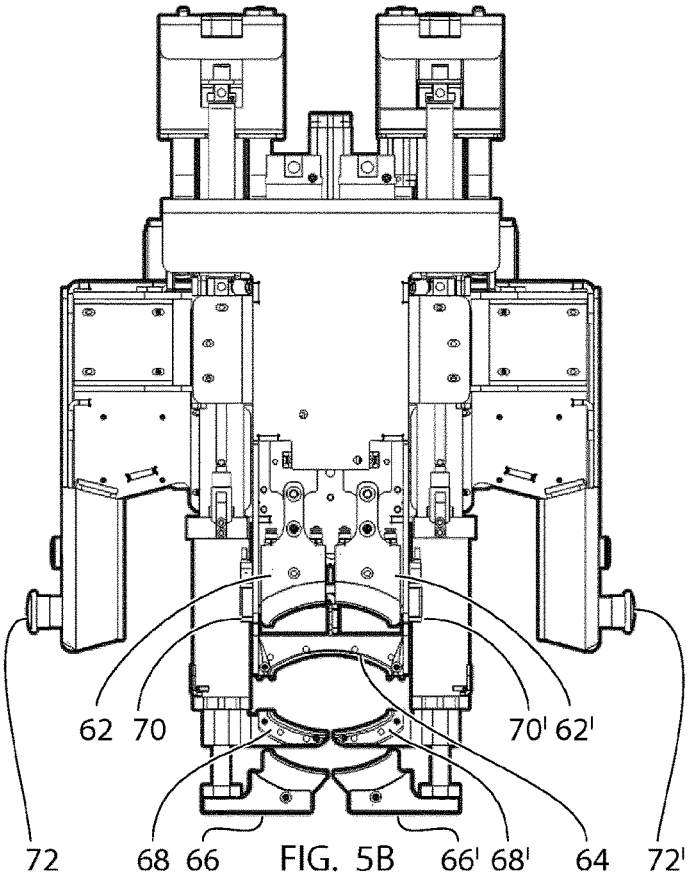
FIG. 5B is a close up view of the first fastening device when in the second position.

FIG. 5B shows a close up view of the first fastening device 42 when the second gripping mechanism 60 has been folded into a use position. The pelt may already have been fixated between the first gripping elements 62 and 62' and the first holding element 64, or alternatively as shown here this step is performed later. The second gripping mechanism 60 including the second gripping elements 66 and 66' and the second holding elements 68 and 68' are thereby first moved in a transverse direction relative to the longitudinal direction of the pelt board and thereafter rotated in order to be located opposite the first gripping mechanism 58 and facing the pelt board space.

Figure 5C:
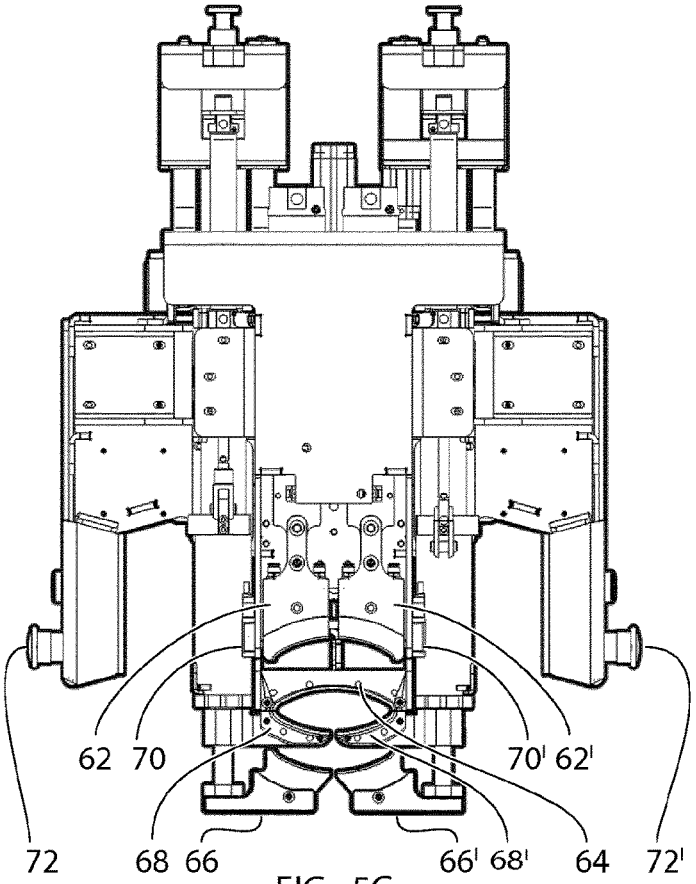
FIG. 5C is a close up view of the holding elements enclosing the pelt board space.

FIG. 5C shows a close up view of the first fastening device 42 when the first holding element 64 and the second holding elements 68 and 68' have been moved towards the pelt board space for enclosing the pelt board.

Figure 5D:
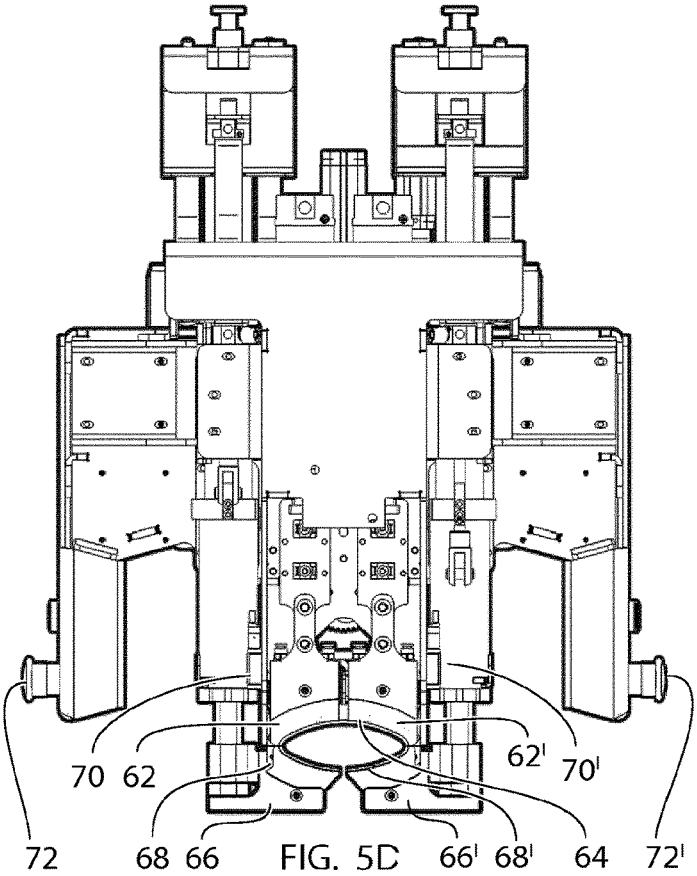
FIG. 5D is a close up view of the fastening of the pelt.

FIG. 5D shows a close up view of the first fastening device 42 when the first gripping elements 62 and 62' have been moved towards the first holding element 64 in order to fasten the rear end of the pelt along the back side contour and the second gripping elements 66 and 66' have been moved towards the second holding elements 68 and 68' in order to fasten the rear end of the pelt along the leg side contour.

Thereafter, the stretching procedure as explained above may be started. Start buttons 72 and 72' may be provided on opposite sides of the first fastening device 42 in order to initiate the stretching procedure. The buttons 72 and 72' must be pressed simultaneously using both hands whereby the risk of personal injury is significantly reduced.

Figure 6A:
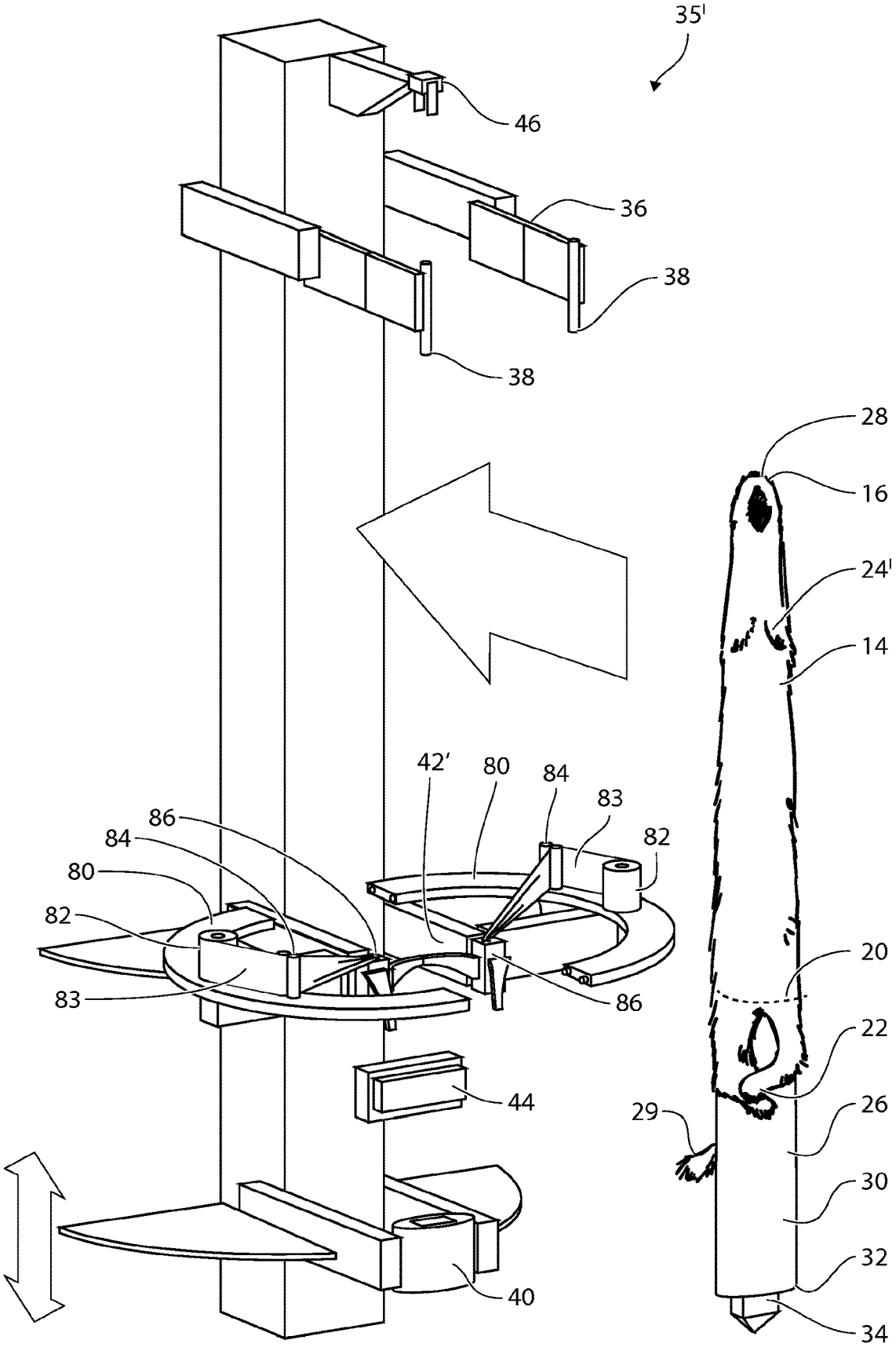
FIG. 6A is a perspective view similar to the view of FIG. 10 of the pelt board and a modified stretching apparatus.

FIG. 6A shows a modified stretching apparatus 35' including basically the same components as described above with reference to FIGS. 1C-1F, however, being supplemented by a wrapping unit to be described in greater details below. In the below description of the modified stretching apparatus 35', components identical to previously described components are designated the same reference numerals as discussed above, whereas components differing from previously described components, however, serving basically the same purpose as a previously described component, are designated the same reference numeral, however, added a marking for identifying the difference or modified functionality. Components previously described will not be described in any greater details below, whereas the modified components will be discussed in relation to their altered or modified functionality.

The modified stretching apparatus 35' shown in FIG. 6A includes two supports 42', on which a respective wrapping table part is mounted. In FIG. 6A, the two wrapping table parts 80 are separated from one another in order to allow the pelt board 26 with the pelt 10 mounted thereon to be received within the stretching apparatus 35' as indicated by a major arrow at the central part of FIG. 6A. Each of the wrapping table parts 80 includes a wrapping foil supply 82, from which a stretchable wrapping foil 83 is discharged, as each of the wrapping foils 83 are guided through foil guides 84. The free ends of the foils 83 are in FIG. 6A fixated or caught by a respective foil catcher element 86, the function of which will be evident from the below description of the wrapping operation.

Figure 6B:
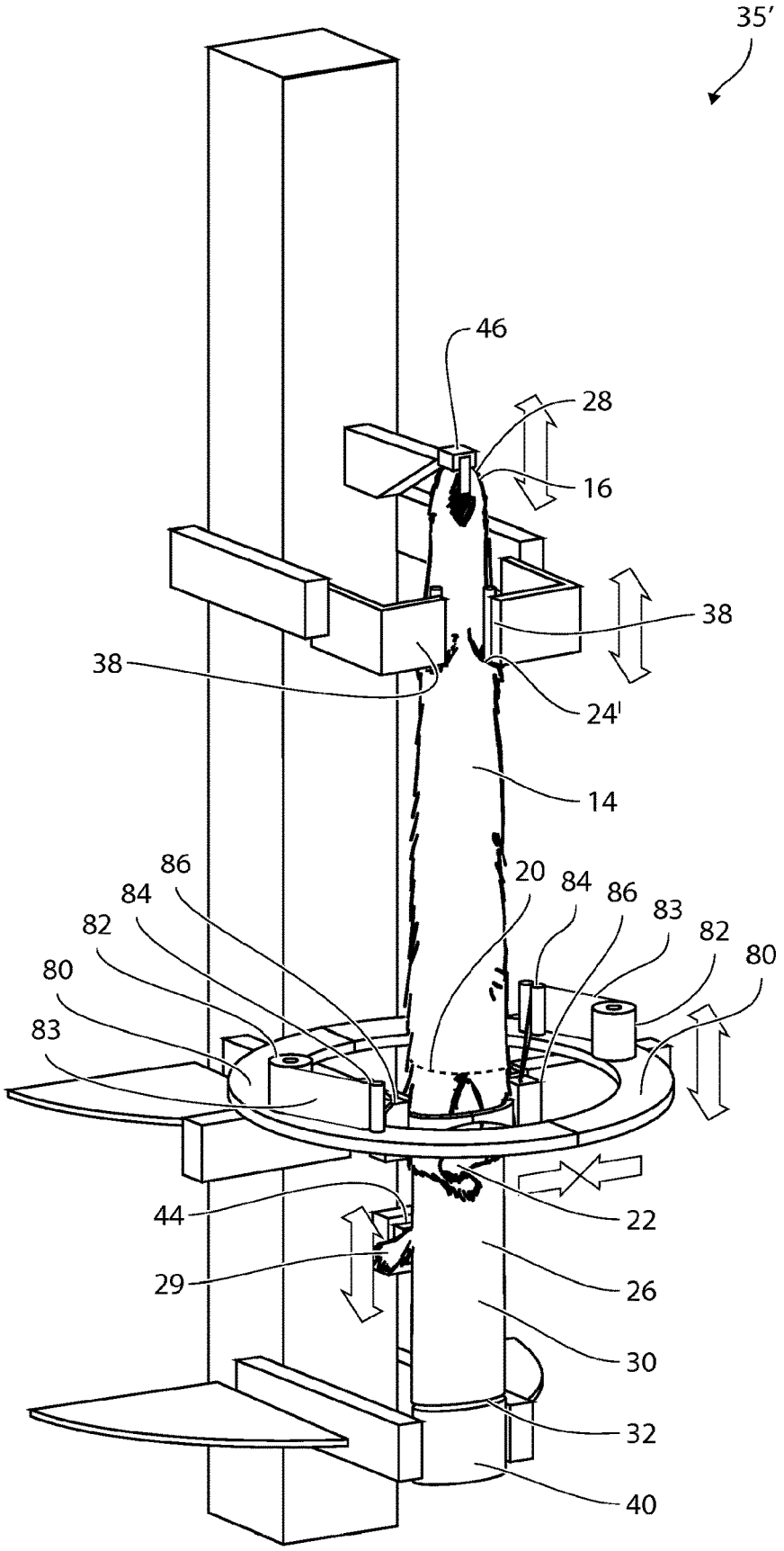
FIG. 6B is a perspective view similar to the view of FIG. 1D of the pelt board and the modified stretching apparatus.
Figure 6C:
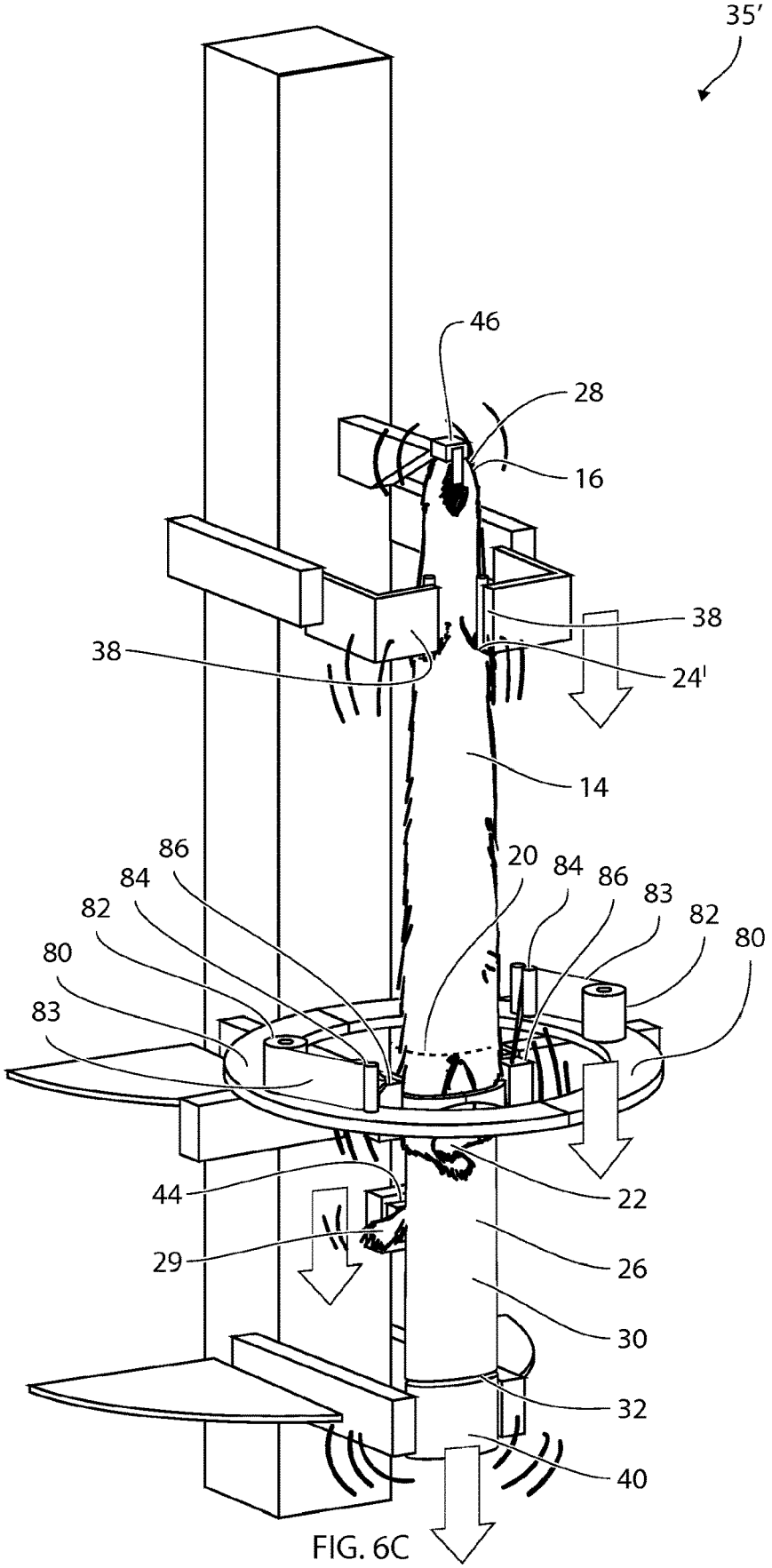
FIG. 6C is a view similar to the view of FIG. 1E of the pelt board and the modified stretching apparatus.
Figure 6D:
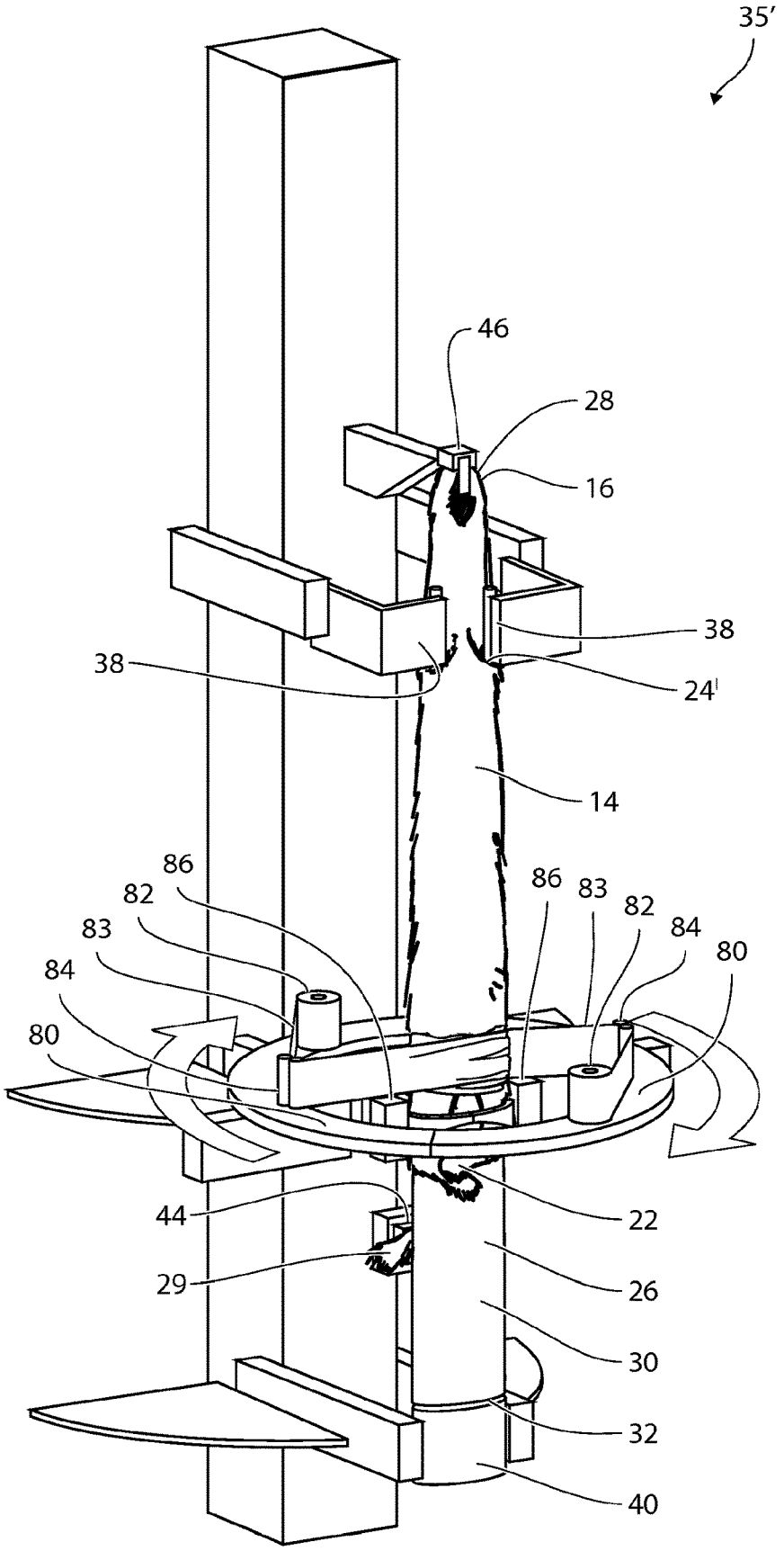
FIG. 6D is a perspective view of the pelt board and the modified stretching apparatus in a first step of fixating the pelt by means of a set of wrapping foils in a wrapping operation.

After the pelt board has been received in the stretching apparatus 35' and is mounted with the connecting element 34 of the pelt board 26 received in the holding device 40, the two wrapping table parts 80 are assembled into a ring-shaped element as each of the wrapping table parts 80 has at a one end a pair of outwardly protruding pins and at the opposite end a pair of holes for receiving the outwardly protruding pins of the adjacent wrapping table part for joining the two wrapping table parts 80 together, as is illustrated in FIG. 6B. In the position of the stretching apparatus 35' shown in FIG. 6B, the stretching operation described above with reference to FIG. 1D is performed, and afterwards, the same stretching operations as described above with reference to FIG. 1E is performed in the process step of the stretching operation, as is illustrated in FIG. 6C. After the stretching of the pelt 10 has been finalized as described above, the wrapping operation is carried out by rotating the wrapping table composed of the two wrapping table parts 80, as is indicated in FIG. 6D by the two arrows shown adjacent to the wrapping table parts 80 of the modified stretching apparatus 35'.

As two symmetrically positioned wrapping components or elements are used in the wrapping operation, the wrapping process as such is carried out more swiftly than by the use of a single wrapping unit including a single wrapping foil and at the same time, due to the symmetrical position of the wrapping elements, including the two wrapping table parts 80, the physical impact in the wrapping operation of stretching the wrapping foil 83 may be increased as the symmetrical drawing of the two symmetrical positioned foils 83 apply forces to the pelt 10 and the pelt board 26, which forces are equalized due to their symmetrical application, which again reduces the necessity as to the strength of the pelt board 26 and the strength of the fixation of the connecting element 34 of the pelt board 26 within the holding device 40.

Figure 6E:
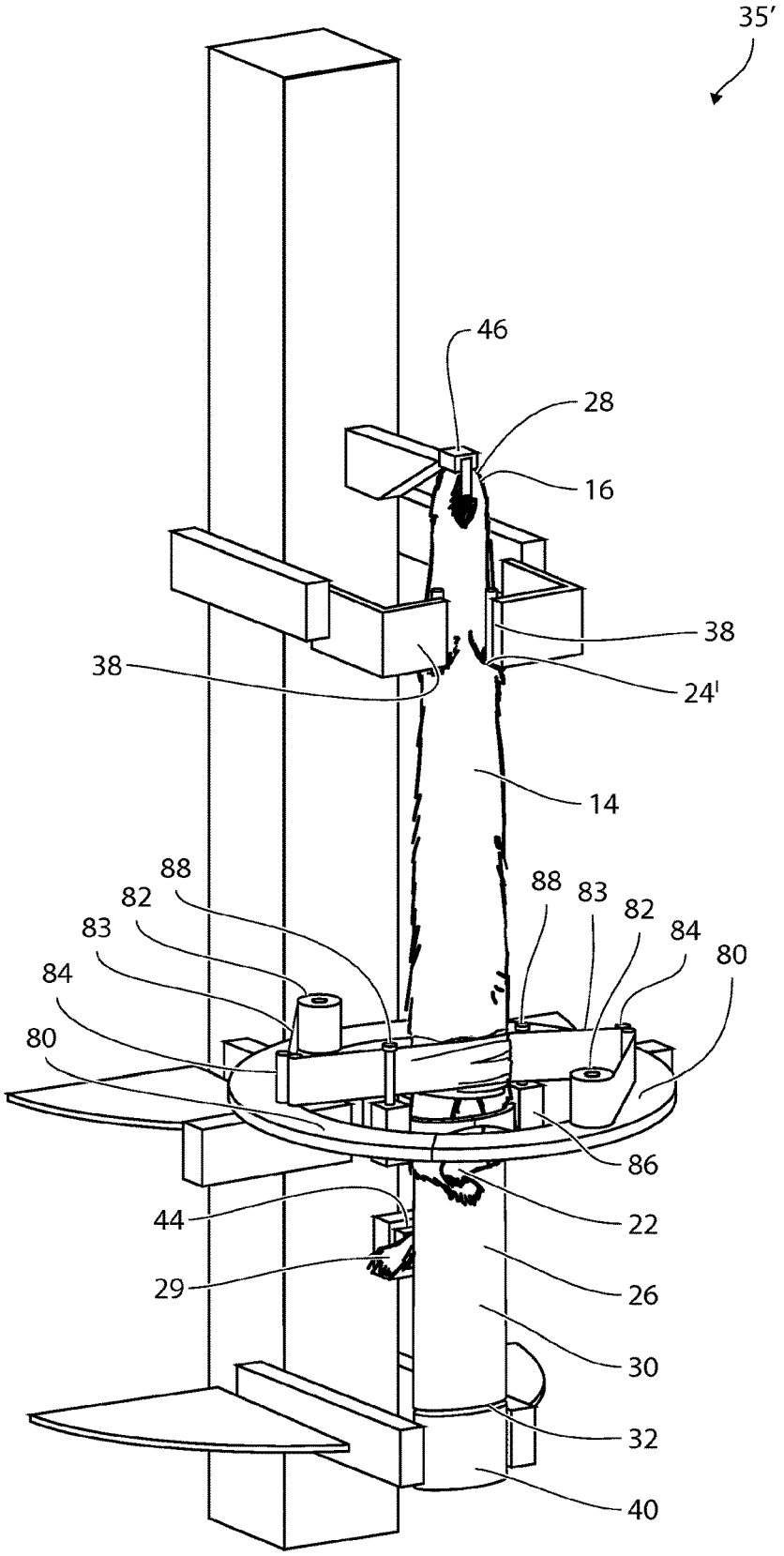
FIG. 6E is a perspective view similar to the view of FIG. 6D of a final step of performing the wrapping operation.
Figure 6F:
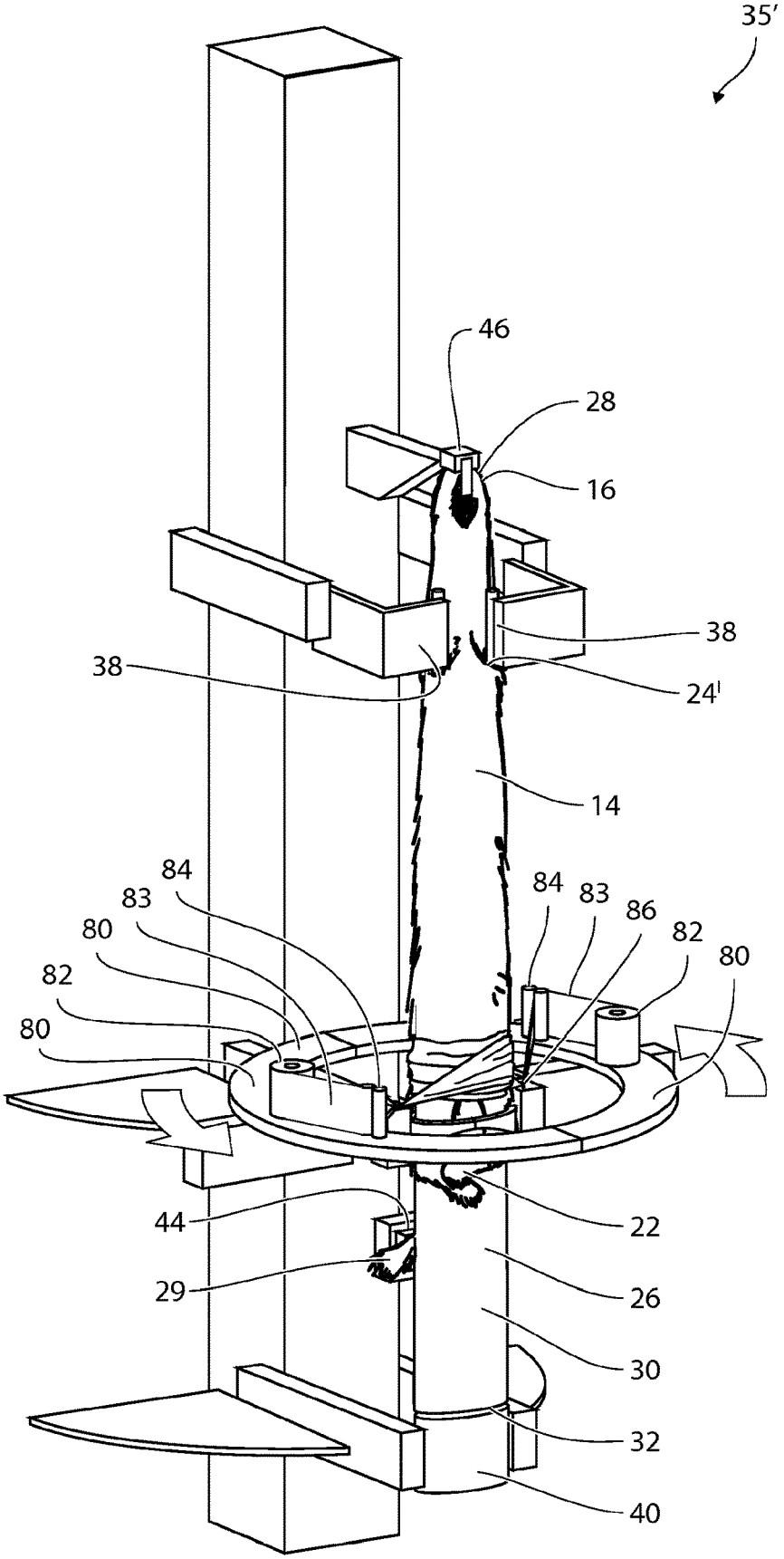
FIG. 6F is a view similar to the views of FIGS. 6D and 6E of the step of cutting the wrapping foils.
Figure 6G:
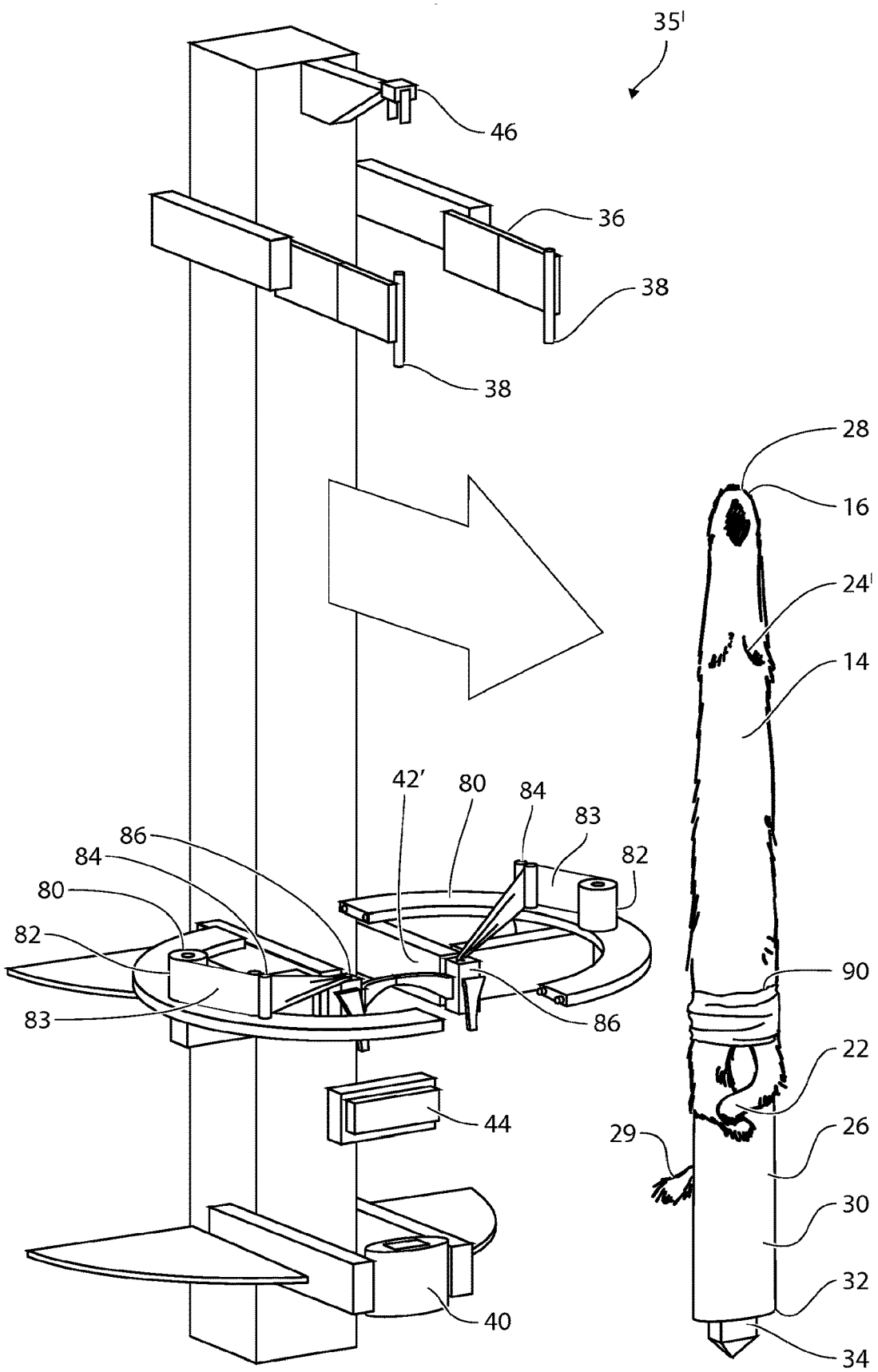
FIG. 6G is a view similar to the views of FIGS. 6D, 6E and 6F of removing the pelt board with the pelt from the stretching apparatus.

After a preset number of turns of the wrapping foils have been applied to the outer surface of the pelt 10 as is illustrated in FIG. 6E, two foil cutters 88 are raised from the elements 86 as is illustrated in FIG. 6E and afterwards, as is illustrated in FIG. 6F, the cutters 88 are lowered again for catching the foils 83 and in doing so, allowing the wrapping table parts 80 to be reversed as is illustrated in FIG. 6F and in doing so, causing the foils to be cut and separated from the foil ends wrapped around the pelt 10 on the pelt board 26. After the separation of the foils applied to the outer surface of the pelt 10, the pelt board 26 is removed from the modified stretching apparatus 35' as is illustrated in FIG. 6G having a band 90 of wrapping foils applied to the pelt 10, which band 90 serves to prevent the pelt 10 from reforming or shrinking to its original length or towards its original length.

Figure 7A:
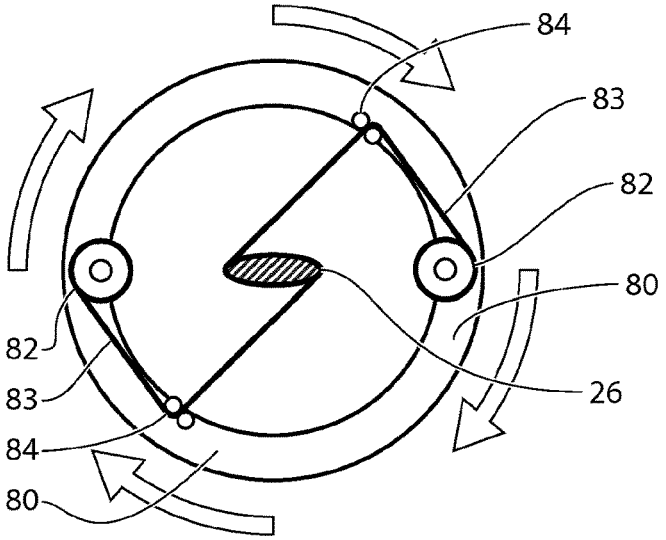
FIGS. 7A, 7B, 7C and 7D are schematic views of alternative implementations of wrapping techniques.
Figure 7B:
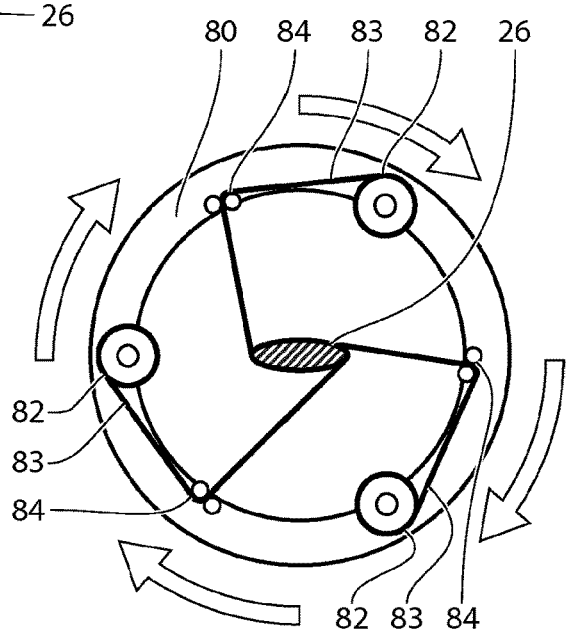
Figure 7C:
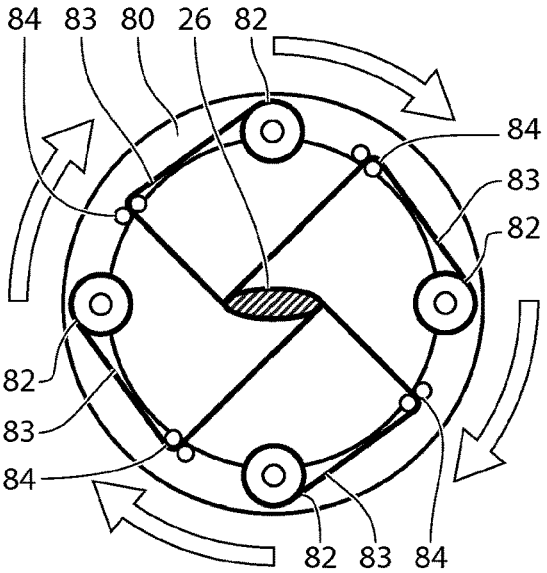

In FIG. 7A, the symmetrical wrapping principle implemented in the modified stretching apparatus 35' described above is illustrated, as the two foil parts 83 are applied to the pelt on the pelt board 26 from opposite sides and applying a symmetrical set of forces to the pelt board 26, which allows for an increased stretching of the foil as compared to a single foil wrapping apparatus. The principle of compensating the forces applied to the pelt board by stretching the wrapping foil may be implemented in numerous other ways, e.g. by applying three or four sets of foils, as is illustrated in FIGS. 7B and 7C, respectively. Evidently, a further number of foil rollers may be applied, provided the angular spacing between the foil rollers is the same between any two set of adjacent foil rollers.

Figure 7D:
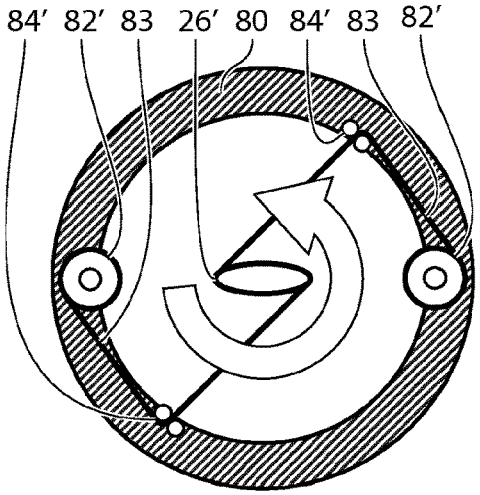

Whereas the wrapping apparatus described above with reference to FIGS. 6A-6G and the schematic illustrations of FIG. 7A-7C illustrate apparatuses, in which the wrapping foil rollers are caused to rotate round the centrally positioned and stationary pelt board 26, the wrapping principle of utilizing symmetrically applied stretching forces to the foils applied from two or more foil rollers may be implemented in an inverse setup, in which the foil rollers are kept stationary, as is illustrated in FIG. 7D, whereas the centrally positioned pelt board 26' is caused to rotate in the wrapping process. As will be evident to a person having ordinary skill in the art, the two foil roller setups of the modified wrapping technique illustrated in FIG. 7D may be modified by the uses of three, four or even more rollers, as is basically shown in FIGS. 7B and 7C.

Figure 8:
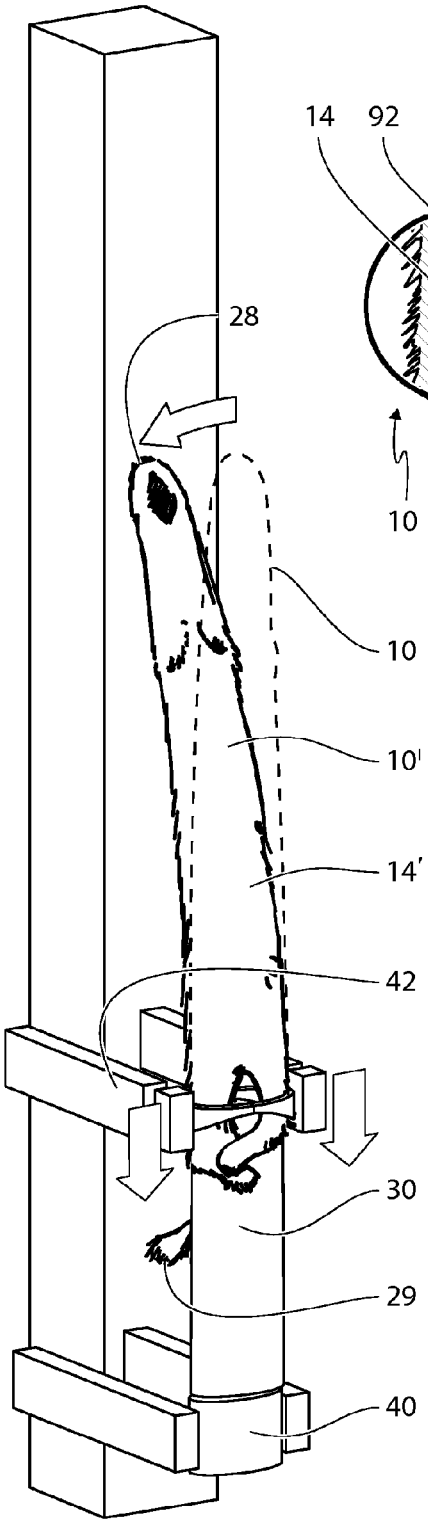
FIG. 8 is a schematic view illustrating somewhat exaggerated the rearward bending of the pelt board with the pelt when stretching the pelt.

FIG. 8 illustrates somewhat exaggerated the rearward bending of the pelt designated the reference numeral 14' when stretching the pelt by the downward movement of the first fastening device 42.

Figure 9A:
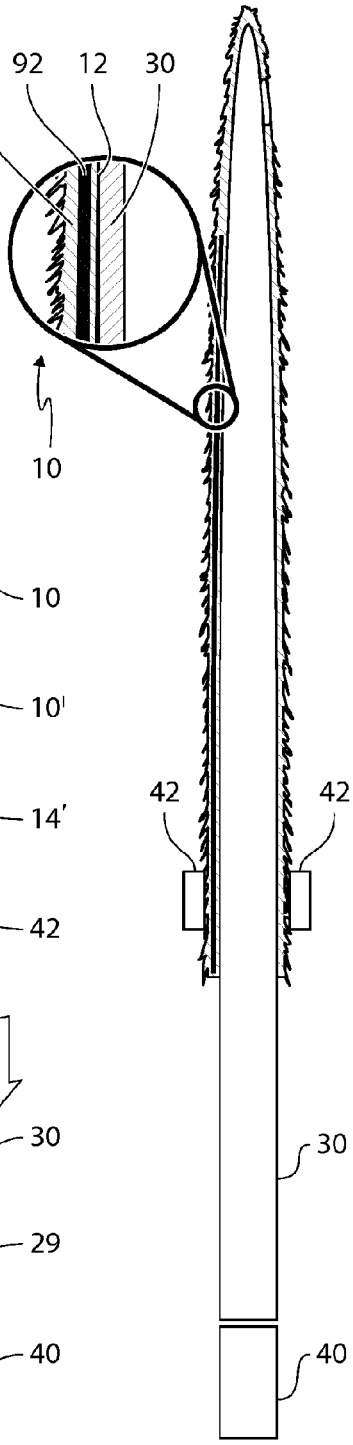
FIGS. 9A and 9B are vertical sectional views illustrating the bending of the pelt board caused by the tendinous ligament of the back piece of the pelt.
Figure 9B:
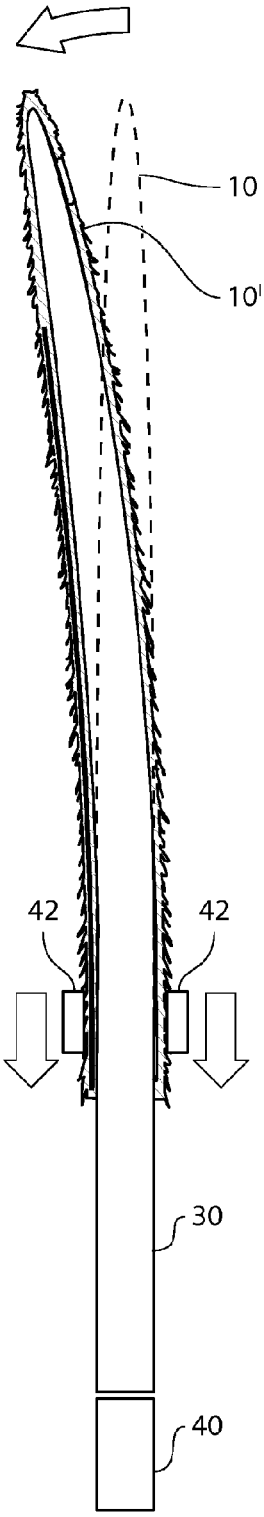

In FIGS. 9A and 9B, the rearward bending of the pelt board 26 is illustrated in greater details and in FIG. 9A, a blow-up view illustrates the structure of the back piece of the pelt, which is positioned contacting the wall 30 of the pelt board 26, which back piece apart from the leather side 12 and the first side of the pelt includes the tendinous ligament 92, which is stronger than the corresponding part of the pelt positioned at the front side of the pelt board, which front side includes no corresponding high strength tendinous ligament. Consequently, as is illustrated in FIG. 9B, the tendinous ligament 92 of the back piece of the pelt 10 causes the pelt board 26 to bend backwards, as the first fastening device 42 is moved downwards for stretching the pelt as no high strength tendinous ligament is present in the front piece of the pelt as compared to the high strength back piece tendinous ligament of the pelt.

In order to prevent the backward bending of the pelt board, which may cause an incorrect stretching of the pelt as the stretching of the pelt is carried out in order to bring the pelt from one class to another according to the Kopenhagen Fur classification system and in case the pelt board is bent backwards as is illustrated in FIG. 9B, the actual length of the pelt may turn out to be somewhat smaller than expected and foreseen by the stretching of the pelt, which then may bring the pelt into a lower class than expected.

Figures 10A, 10B:
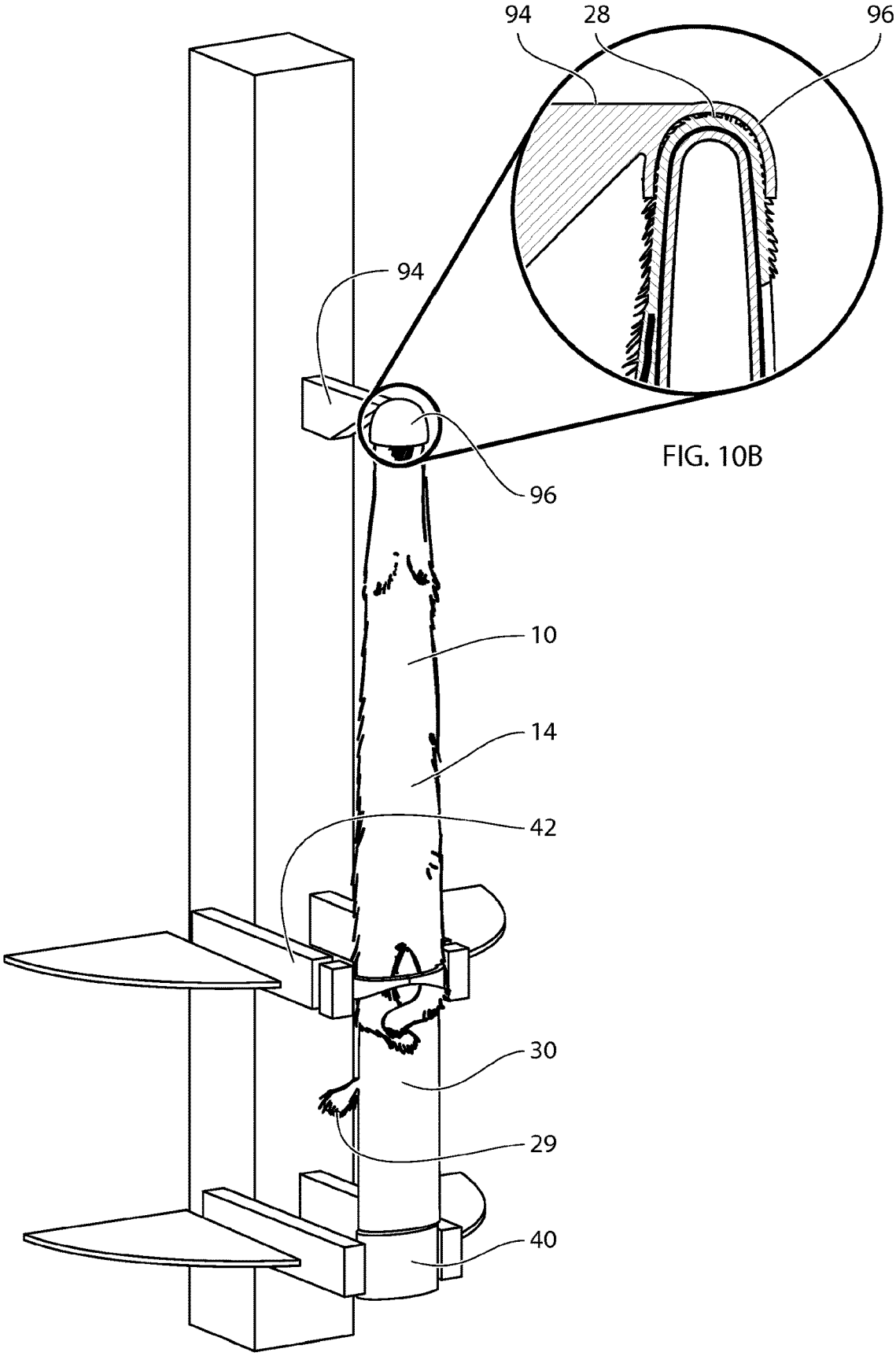
FIGS. 10A and 10B are views illustrating a first embodiment for compensating the bending of the pelt board caused by the tendinous ligament of the pelt.
Figures 11A, 11B:
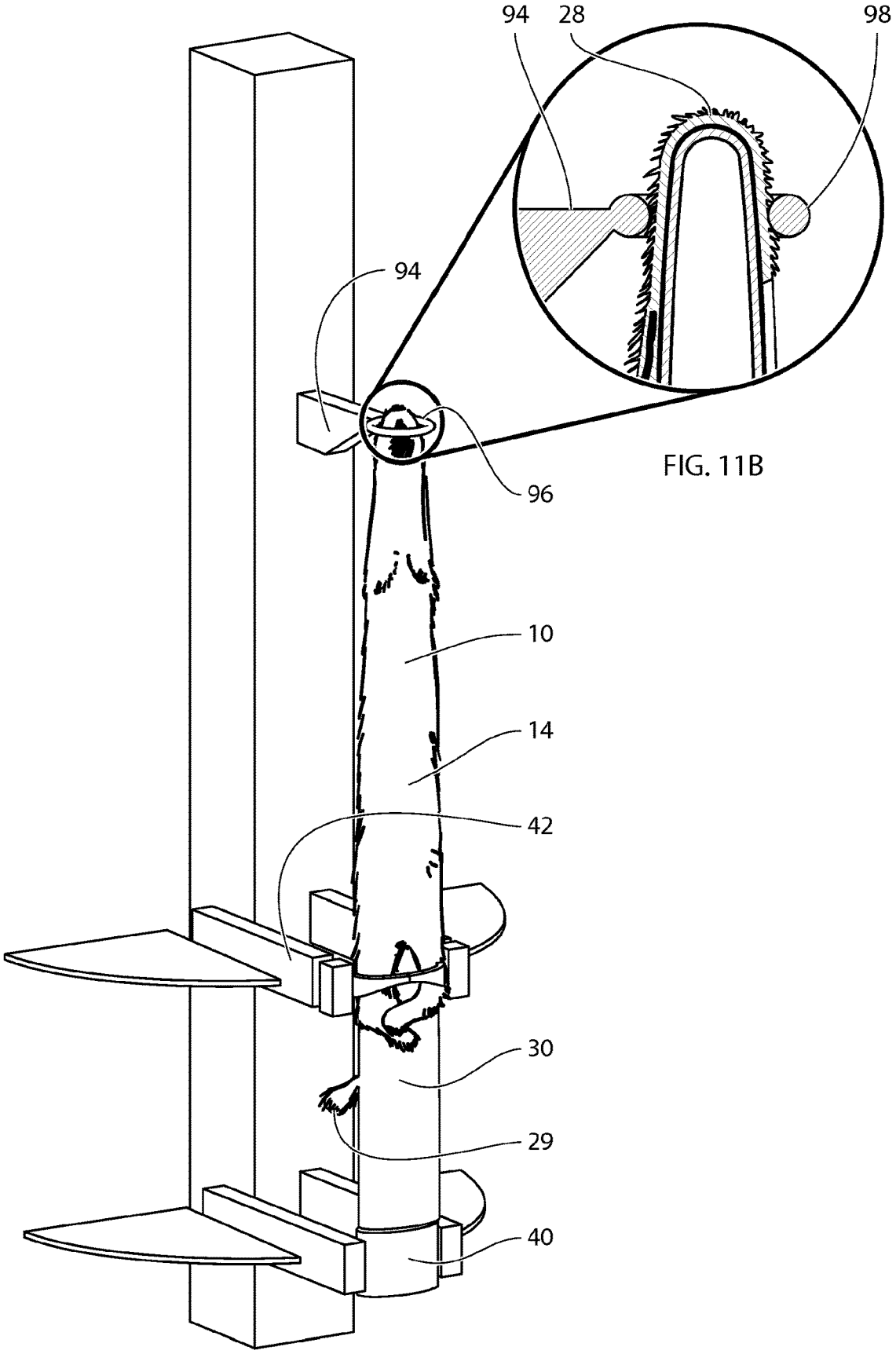
FIGS. 11A and 11B are views illustrating a second embodiment for compensating the bending of the pelt board caused by the tendinous ligament of the pelt.
Figures 12A, 12B:
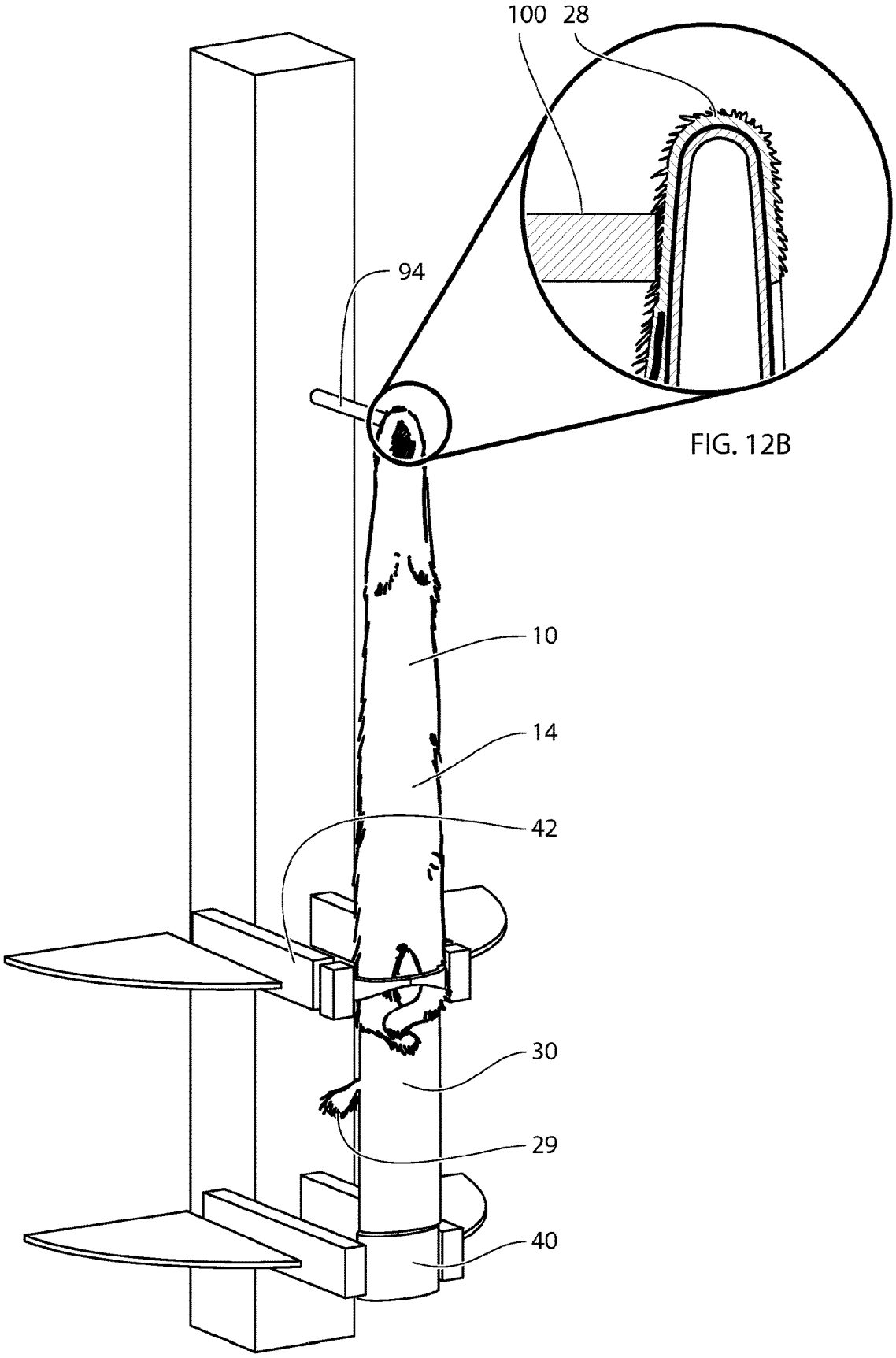
FIGS. 12A and 12B are views illustrating a third embodiment for compensating the bending of the pelt board caused by the tendinous ligament of the pelt.

According to three difference embodiments of the means for preventing the backward bending of the pelt board, an arresting and supporting arm 94 is provided in FIG. 10A, which arresting and supporting arm has a cup-shaped end part 96 serving to catch round the nose end of the pelt and in doing so, preventing the backward bending as illustrated in FIG. 9B of the pelt board when stretching the pelt. An alternative embodiment of the means for preventing backward bending of the pelt board is illustrated in FIGS. 11A and 11B, and is constituted by the combination of an arresting and supporting arm 92 and a ring-shaped end part 98 serving to circumferentially encircle the nose end of the pelt 10 and in doing so, contacting the outer first side of the pelt when the pelt board tends to bend backwardly, as is illustrated in FIG. 9B. A third embodiment of the backward bending preventing means is constituted by a simple arresting and supporting arm 100 shown in FIGS. 12A and 12B, which arm simply contacts the nuchal of the pelt as the stretching of the pelt tends to cause the pelt board to bend backwardly, as is illustrated in FIG. 9B.

Figure 13A:
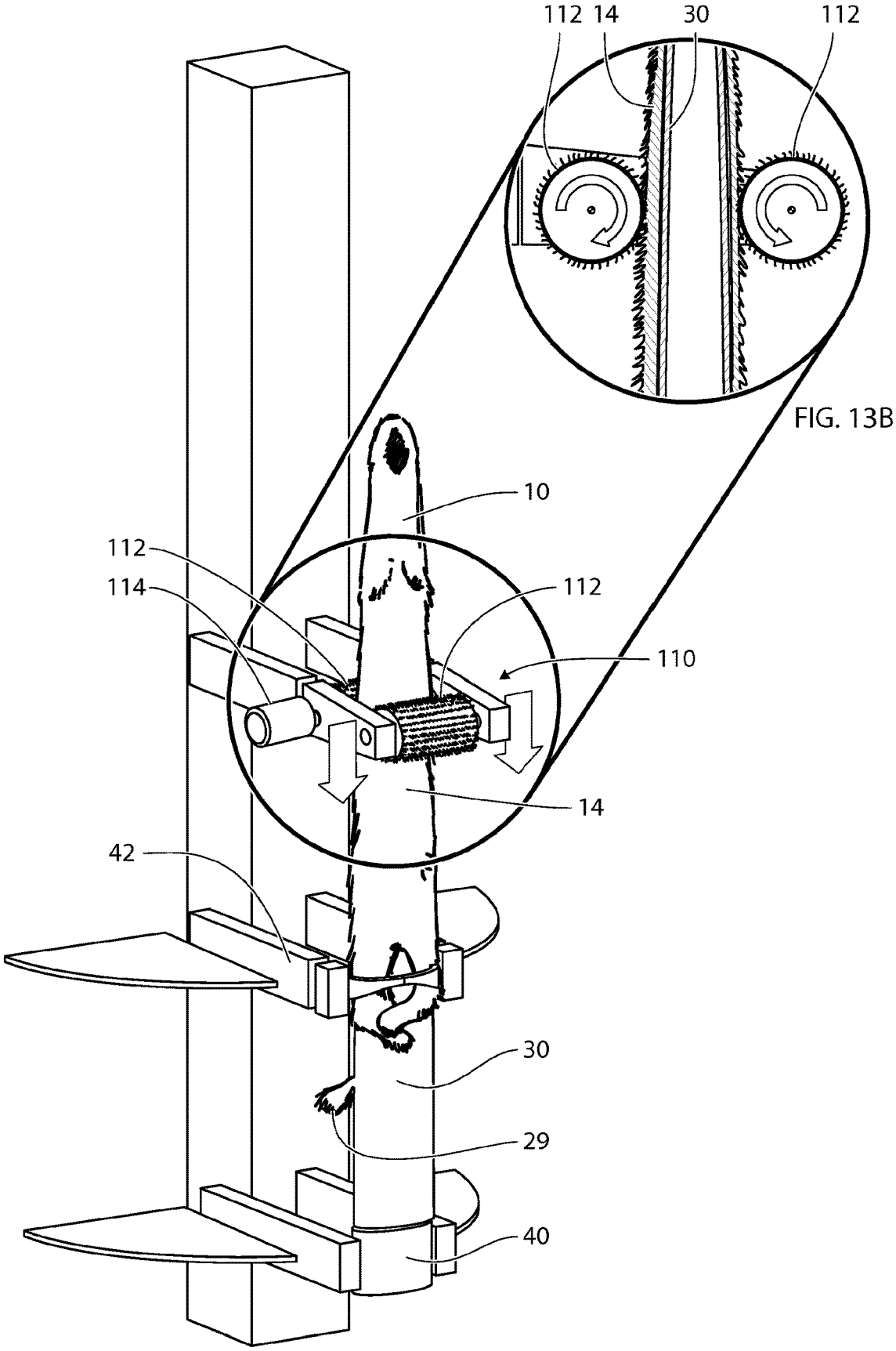

In FIGS. 13A and 13B is shown the stretching apparatus according to the present invention including a tool designated the reference numeral 110 serving to process the fur side of the pelt 10. The processing tool 110 comprises a pair of supporting arms, on which a set of rollers 112 are mounted, which motors are driven by a motor 114 for causing the rollers to rotate in opposite directions, as is shown in the enlarged sectional view of FIG. 13B. As is indicated by arrows, the fur processing tool 110 may be lowered from a top position juxtaposed the nose end of the pelt to a lower position at the rear end of the pelt for arranging the hair of the pelt in a proper organized orientation. The rollers 112 may be substituted by other relevant fur processing elements, such as combs or brushes serving the overall purpose of improving the quality of the pelt in question.

Figures 14A, 14B:
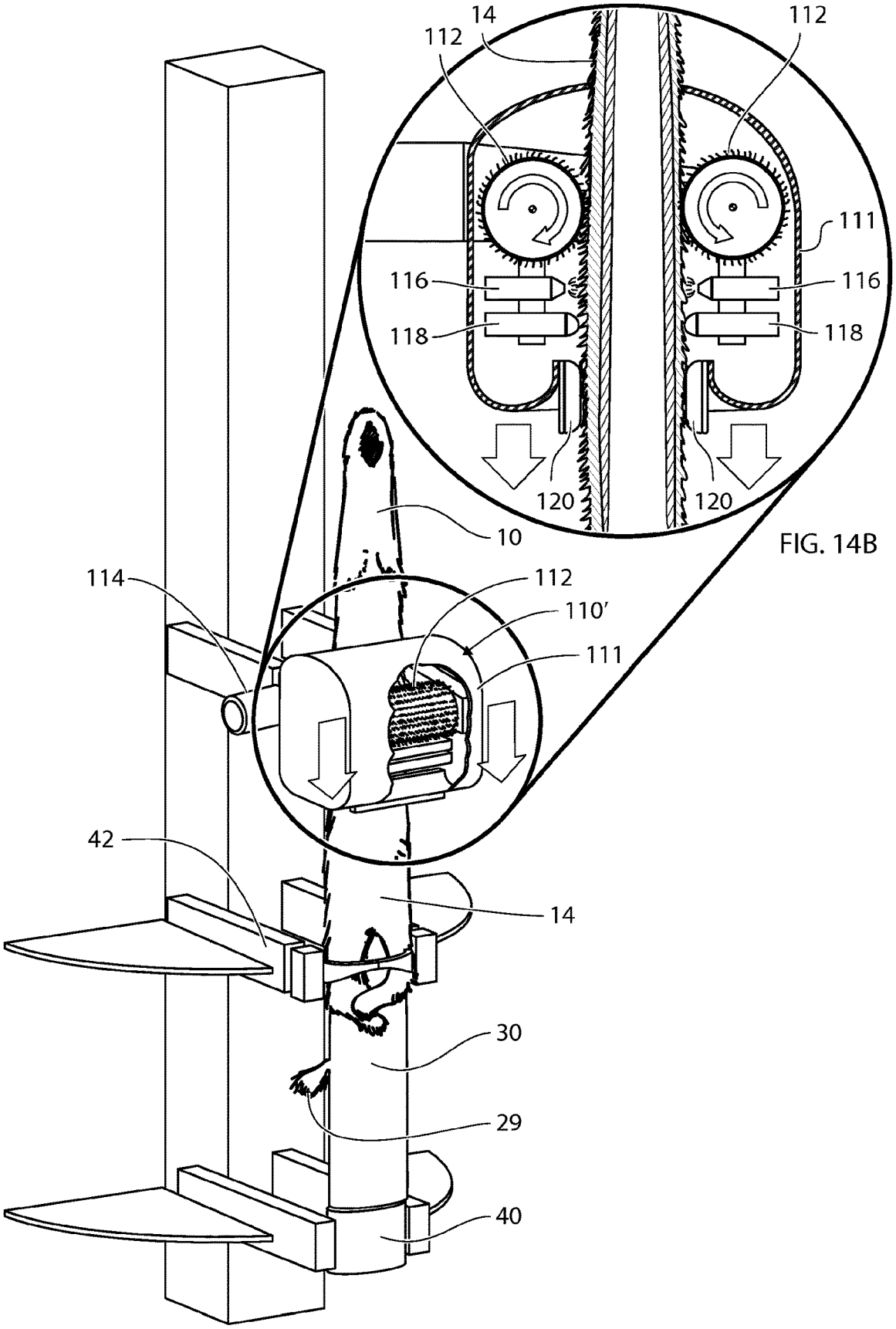
FIGS. 14A and 14B are views similar to the views of FIGS. 13A and 13B, respectively, illustrating a variant of the stretching apparatus according to the present invention.

In FIGS. 14A and 14B is shown a modified embodiment of the stretching apparatus according to the present invention shown in FIGS. 13A and 13B, respectively. The embodiment shown in FIGS. 14A and 14B basically differs from the embodiment shown in FIGS. 13A and 13B, respectively, in that the processing tool designated the reference numeral 110' for identifying the amendment of the processing tool as compared to the processing tool 110 described above in that the processing tool 110' is housed within an incasing 111 enclosing the rollers 112 and further housing a set of water discharge nozzles 116 for the discharging of or dispensing water onto the fur side of the pelt 14 and in addition, a pair of contacting pads are provided for contacting the pelt 14. The lower end of the encasing 111 is provided with a pair of pressure pads, simply for contacting the outer side of the fur 14 and in doing so, providing a seal enclosure housing the processing tool 110.

It is to be realized that the function of the processing tools 110 and 110' shown in FIGS. 13A, 13B and FIGS. 14A, 14B, respectively, basically functions as described in DK 176421 B1.

Figure 15:
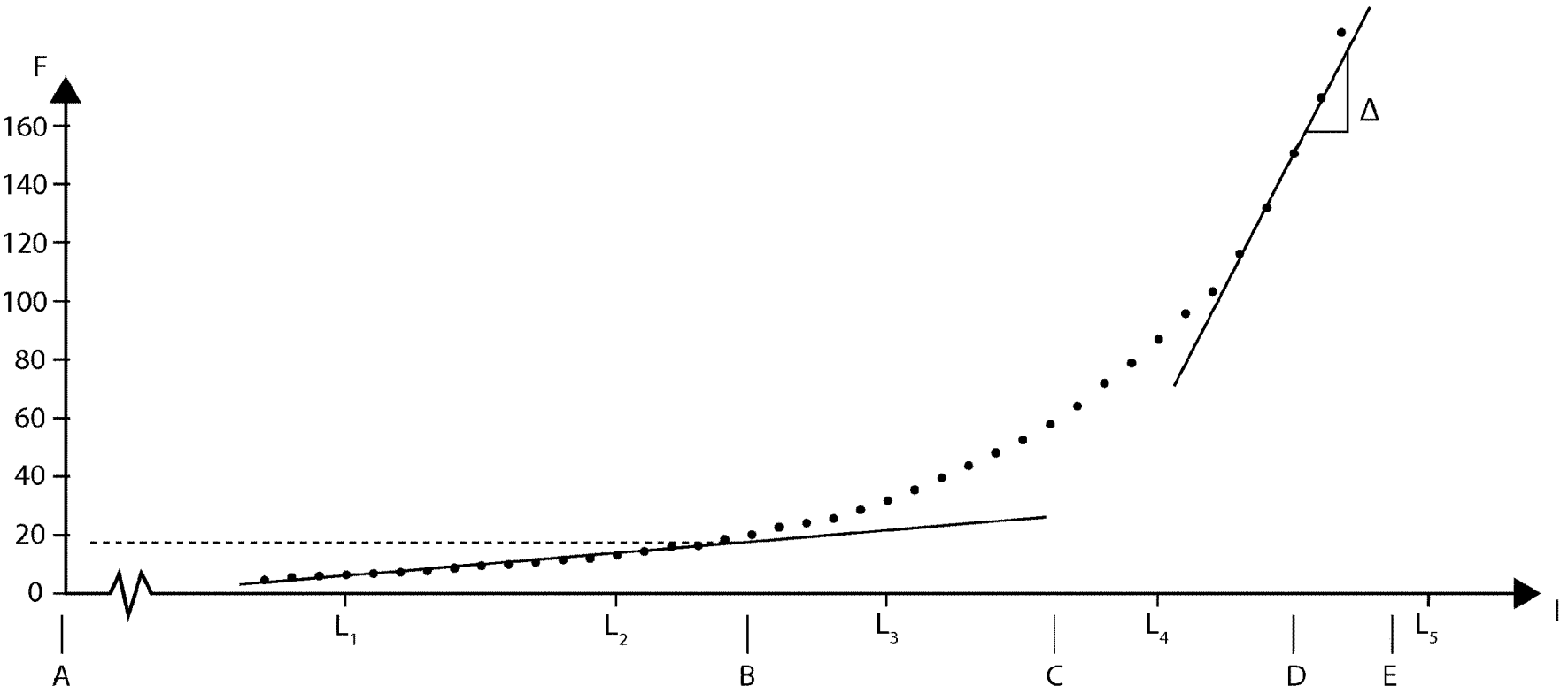
FIG. 15 is a graph illustrating the correspondence between the force which is applied to a specific pelt and the lengths produced by the force applied.

FIG. 15 is a diagrammatic view illustrating empirical data obtained by stretching a pelt of a mink, the mink being a male mink, while recording the length of the pelt and the force applied to the pelt as the pelt is stretched by means of the stretching assembly described above with reference to FIGS. 1-5. The stretching is produced by moving the holding device 40 relative to the top end 28 of the pelt board 26 and in doing so performing a total stretching of the pelt between the nose 16 of the pelt 10 and the rear leg 22 or tail end of the pelt 10. Along the abscissa axis, the length of the pelt is recorded and along the ordinate axis, the force applied is recorded.

In FIG. 15, markings A, B, C, D and E are provided, which markings correspond to the illustrations of FIG. 16A-16E to be described below, and the curve recorded as an incremental or stepwise recording of the correspondence between the actual length of the pelt and the force applied exhibit evidently the characteristics of a curve which initially has a low tangential gradient and at its end at the point E at which point the pelt is broken, exhibits an almost vertical tangential gradient.

According to the empirical data shown in FIG. 15, a highly advantageous feature characteristic of the present invention has been deduced, namely the feature of simply allowing the stretching to be performed initially without paying any careful attention to the stretching operation, and in doing so stretching the pelt until a pre-set safe force value or safe force gradient value has been reached as is indicated by B. In B, the curve illustrating the correspondence between the incremental increase of the length of the pelt and the force applied to the pelt for increasing the length of the pelt starts rising and in doing so indicates that the stretching now is becoming more critical as further stretching of the pelt may cause damage to the pelt eventually causing the pelt to be broken indicated by E.

According to a further feature characteristic of the present invention, the corresponding values of the length of the pelt while applied to a stretch force and the stretch force are recorded and at the same time, the gradient increase determined as the increase from a previous corresponding set of data is recorded as the force gradient is considered to be a reliable and predictable measure indicating the shift from the safe stretching of the pelt until point B and the gradual dramatic force increase for obtaining a further incremental increase of the length of the pelt. Consequently, it is contemplated that the force gradient as such is indicative of the safe continuous operation of stretching the pelt and the reaching of a gradient exceeding a specific value such as the value in point D constitutes a maximum predicted safe value for further stretching the pelt.

The values when stretching a male mink, the values L1, L2, L3 and L4 may constitute measures of 750, 800, 850 and 900 mm, respectively, and the upper limit of L5 may typically be of the order of 950 mm although the proved techniques of feeding the animals has throughout the last 10-15 years dramatically increased the maximum length of male and female minks from approximately 80 cm to 100 cm or even more.

Due to the increase in the overall length of the pelt of minks due to the above-described improved feeding techniques, the curve of FIG. 15 has changed and will in the future be changed, however, it is contemplated that the general configuration or shape of the curve illustrated in FIG. 15 is universally applicable and further according to an advantageous feature of the present invention, the data recorded while stretching a single pelt may be recorded and stored and compared with data from the operation of stretching different animals pelts and in doing so establishing what is well known in the computer technical field an iterative learning process. As will be understood, the measure for determining the safe maximum force to be applied to a pelt is, according to the teachings of the present invention, not determined by the length of the pelt but rather by the maximum force gradient and the force to be applied which values are consequently independent of the actual length of the pelt exposed to the stretching operation as such.

Figure 16E:
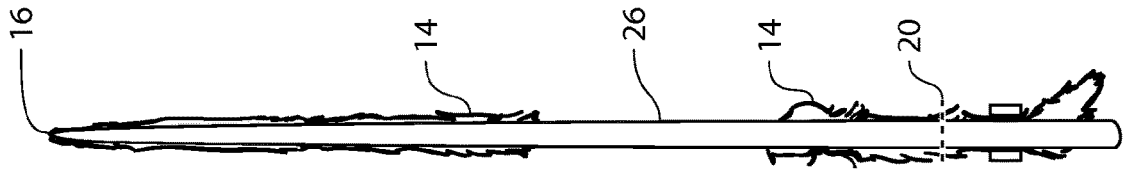
FIGS. 16A-16E are schematic and sectional views of a pelt board and a pelt applied thereto corresponding to indication of the length of the pelt indicated in FIG. 15.
Figure 16D:
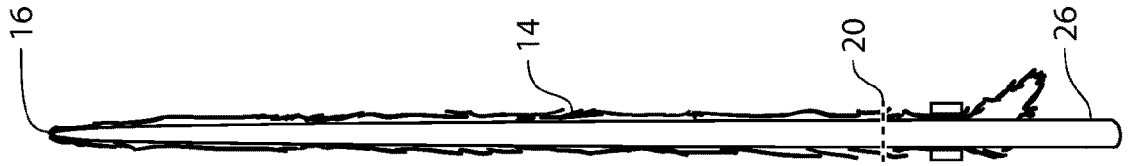
Figure 16C:
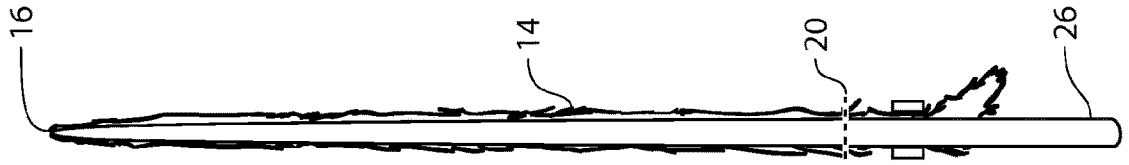
Figure 16B:
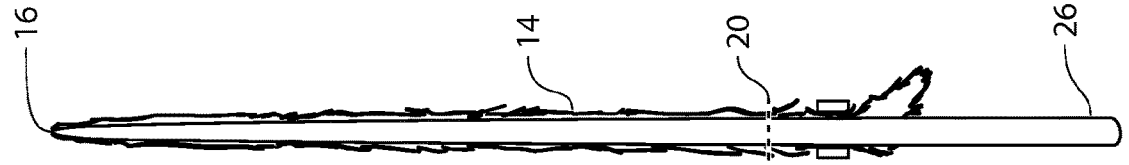
Figure 16A:
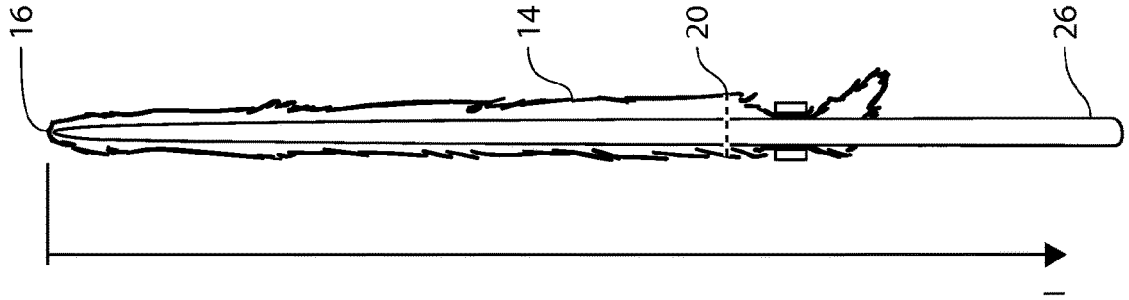

In FIGS. 16A-16E are shown schematic and vertical sectional views of the pelt board 26 having the pelt 14 applied to the pelt board and also indicating the imaginary line 20 indicating the length of the pelt generated while stretching the pelt as described above with reference to FIG. 1-5 and generating the corresponding length and force data shown in FIG. 15. To be more precise, FIG. 16A illustrates the original length of the pelt 14 in its unstretched state, i.e. prior to applying any force to the pelt while the pelt is simply initially resting on the pelt board and afterwards exposed to a stretching force. According to the teachings of the present invention, no data recording is performed in the initial positioning of the pelt on the pelt board as the initial data, or to be more precise, the initial length of the pelt at the time of applying the pelt to the pelt board has no bearing on the ability of the pelt to be stretched. FIG. 16B illustrates the pelt 14 stretched to the safe stretching value B of FIG. 15 indicated by the dotted line illustrating the safe force applied and also the safe force gradient at the point B. By further stretching the pelt while producing the recordal of the data shown in FIG. 15, the pelt is stretched further as indicated in FIGS. 16C and 16D, in which FIG. 16D illustrates the upper limit or the safe upper limit of stretching the pelt as further stretching of the pelt exceeding the safe force gradient value determined in D causes the pelt to be broken as is illustrated in FIG. 16E.

In the process of stretching the pelt of a mink, the classification according to the international standard established by Kopenhagen Fur A/S has to be taken into consideration and in this context, the graph of FIG. 15 may be used for predicting as a forecast whether a specific maximum class has been reached or a safe further stretching may bring the pelt from the class presently obtained to a further class as it is to be realized that the incremental difference between the two classes is 6 cm and the stretching of the pelt therefore should be carried out in order to reach the maximum class possible rather than reach the maximum length possible since stretching the pelt beyond a class limit without reaching the next class does not yield any financial pay off for the pelt in question. As stated above, the difference between L3 and L5 is 50 cm corresponding to more than 6 classes for which reason it is readily understood that the further extension or stretching of the pelt from B to D involves the increase of the length of approximately 100 cm corresponding to more than 16 classes.

Although the present invention has above been described with reference to a specific and presently preferred embodiment of the invention together with schematically illustrated variants of the apparatus according to the present invention, the invention may, as will be evident to a person having ordinary skill in the art, readily be modified without deviating from the scope of the present invention as defined in the appending claims.

First Set of Points Describing Features of the Invention

1. A stretching apparatus for stretching a pelt on a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, said stretching apparatus comprising:
   - a holding device for holding said base end of said pelt board, and
   - a stretching device having a pair of stretching members, each of said stretching members being adapted for being inserted into a respective front leg cavity of said pelt, said stretching device being movable in a direction towards said holding device for stretching said pelt.

2. The stretching apparatus according to point 1, wherein said stretching members comprise cylindrical pins.

3. The stretching apparatus according to any of the preceding points, wherein said apparatus comprising a first fastening device for fastening said rear end of said pelt, said first fastening device being movable in a direction towards said holding device for stretching said pelt.

4. The stretching apparatus according to any of the preceding points, wherein said apparatus comprises a second fastening device for fastening a tail part extending from said rear end of said pelt, said second fastening device being movable in a direction towards said holding device for stretching said pelt.

5. The stretching apparatus according to any of the preceding points, wherein said apparatus comprises a third fastening device for fastening and fixating said nose end of said pelt, said third fastening device being movable in a direction towards said holding device for stretching said pelt.

6. The stretching apparatus according to any of the preceding points, wherein said stretching device, said first fastening device and/or said second fastening device and/or said third fastening device is/are movable by means of a pneumatic drive, a hydraulic drive or a spindle drive.

7. The stretching apparatus according to any of the preceding points, wherein said first fastening device and/or said second fastening device comprises opposing gripping members for gripping said pelt between said inwardly oriented leather side and said outwardly oriented fur side.

8. The stretching apparatus according to any of the preceding points, wherein said holding device, said stretching device, said first fastening device, said second fastening device and/or said third fastening device comprises one or more vibration actuators for inducing one or more oscillations onto said pelt.

9. The stretching apparatus according to point 8, wherein said vibration actuator operates at a frequency of between 1 Hz and 100 Hz.

10. The stretching apparatus according to any of the preceding points, wherein said stretching device, said first fastening device, said second fastening device and/or said third fastening device comprises a compressed air outlet for temporarily removing any fur hair located adjacent said compressed air outlet.

11. The stretching apparatus according to any of the preceding points, wherein said stretching apparatus further comprises a holding bag applicator.

12. The stretching apparatus according to any of the preceding points, wherein said base end of said pelt board comprises a connecting element and said holding device comprises a locking part for locking said connecting element to said holding device.

13. The stretching apparatus according to any of the preceding points, wherein said pair of stretching members are interconnected by a rack and pinion actuator.

14. A stretching apparatus for stretching a pelt on a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said stretching apparatus comprising:
   - a holding device for holding said base end of said pelt board, said stretching apparatus defining a pelt board space extending outwardly along a longitudinal direction from said holding device for accommodating said pelt board,
   - a stretching device having a pair of stretching members, each of said stretching members being adapted for being inserted into a respective front leg cavity of said pelt, said stretching device being movable in a direction towards said holding device for stretching said pelt, and
   - a fastening device, said fastening device comprising a first gripping mechanism for fastening said rear end of said pelt along either said back side contour or said leg side contour, and a second gripping mechanism for fastening said rear end of said pelt along either said leg side contour or said back side contour, respectively, said first gripping mechanism and said second gripping mechanism being movable in said longitudinal direction and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.

15. A method of stretching a pelt on a pelt board comprising performing the steps of:
   - providing said pelt and said pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, providing a stretching apparatus comprising a holding device and a stretching device, said stretching device having a pair of stretching members, holding said base end of a pelt board by said holding device, inserting each of said stretching members of said stretching device into a respective front leg cavity of said pelt, and moving said stretching device in a direction towards said holding device, thereby stretching said pelt.

Second Set of Points Describing Features of the Invention

1. An apparatus for fixating a pelt to a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said pelt and a base end located opposite to said top end, said apparatus comprising:

a holding device for receiving said base end of said pelt board and holding said pelt board, a fastening device having a pair of and preferably two pairs of gripping members for gripping and arresting said pelt relative to said pelt board by gripping and fastening said rear end of said pelt relative to said pelt board, and a wrapping device including at least two foil wrapping units for wrapping foil round said pelt at said rear end of said pelt for fixating said pelt to said pelt board, said at least two foil wrapping units being positioned so as to apply said wrapping foils to said pelt from positions causing the pull from each of said foils to be equalized by the pull of the other foil or the other foils.

2. The apparatus according to point 1, said two foil wrapping units being positioned at opposite sides of said pelt board and symmetrical relation to said pelt board for applying said wrapping foils from opposite sides of said pelt board.

3. The apparatus according to point 1, said foil wrapping units being present in a number n and the angular spacing between any two adjacent wrapping foil units being 360°/n.

4. The apparatus according to any of the preceding points, said wrapping units being rotated relative to said pelt board for applying said wrapping foils to said pelt.

5. The apparatus according to any of the points 1-3, said wrapping units being stationary and said pelt board being rotated relative to said wrapping units for causing said wrapping foils to be wrapped round said pelt.

6. The apparatus according to any of the points 1-5, further having any of the features of the points describing features of the invention listed above.

7. A method of fixating a pelt to a pelt board comprising performing the steps of:

providing said pelt and said pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said pelt and a base end located opposite to said top end, providing an apparatus comprising a holding device, a fastening device and a wrapping device, said holding device serving to receive said base end of said pelt board and holding said pelt board, said fastening device having a pair of and preferably two pairs of gripping members for gripping and arresting said pelt relative to said pelt board by gripping and fastening said rear end of said pelt relative to said pelt board, said wrapping device including at least two foil wrapping units for wrapping foil round said pelt at said rear end of said pelt, the method further comprising:

positioning said pelt board in said holder, fastening said pelt relative to said pelt board by means of said pair or preferably two pairs of gripping members after stretching said pelt on said pelt board and wrapping foils from said at least two foil wrapping units round said pelt at said rear end of said pelt for fixating said pelt to said pelt board and in doing so, applying said wrapping foils to said pelt from positions causing the pull from each of said foils to be equalized by the pull of the other foil or other foils.

8. The method according to point 7, further having any of the features of the apparatus according to the points 2-6.

Third Set of Points Describing Features of the Invention

1. A stretching apparatus for stretching a pelt on a pelt board, said pelt having a substantially tubular shape defining an inwardly oriented leather side, an outwardly oriented fur side, a nose end, a rear end and a back piece including a tendinous ligament, said pelt board defining a top end for accommodating and fixating said nose end of said pelt, a circumferential wall for facing said inwardly oriented leather side of said of said pelt and a base end located opposite said top end, said stretching apparatus comprising:

a holding device for holding said base end of said pelt board, a fastening device for fastening said rear end of said pelt and being movable relative to said holding device for stretching said pelt, and an arresting device for arresting and supporting said top end of said pelt board for preventing said tendinous ligament from causing said pelt board to bend when stretching said pelt.

2. The stretching apparatus according to point 1, said arresting device being constituted by an arm having an arm end part for catching said top end of said pelt board.

3. The stretching apparatus according to point 1 or 2, said arresting device including a ring shaped end part for circumferentially enclosing and supporting said pelt board at said nose end of said pelt when stretching said pelt.

4. The stretching apparatus according to point 1 or 2, said arresting device including a cup-shaped end part for enclosing said nose end of said pelt at said top end of said pelt board.

5. The stretching apparatus according to any of the points 1-4, further having any of the features of the stretching apparatus according to the points of the first set of points and/or the second set of points.

6. A method of stretching a pelt on a pelt board comprising the steps of:

providing said pelt on said pelt board, said pelt having a substantially tubular shape defining an inwardly oriented leather side and an outwardly oriented fur side, a nose end, a rear end and a back piece including a tendinous ligament, said pelt board defining a top end for accommodating and fixating said nose of said pelt, a circumferential wall for facing said inwardly oriented leather side of said pelt and a base end located opposite said top end, providing a stretching apparatus comprising a holding device, a fastening device and an arresting and supporting device, said holding device serving to hold said base end of said pelt board, said fastening device to fasten said rear end of said pelt, said arresting and supporting device serving to support said top end of said pelt board for preventing said tendinous ligament from causing said pelt board to bend when stretching said pelt, positioning said pelt on said pelt board, positioning said pelt board in said holding device prior to or after arranging said pelt on said pelt board, fastening said fastening device to said rear end of said pelt, moving said fastening device relative to said holding device for stretching said pelt and in doing so, supporting said top end of said pelt board by means of said arresting and supporting device.

7. The method according to point 6, further having any of the features of the points according to the first set of points and/or the second set of points.

Fourth Set of Points Describing Features of the Invention

1. A stretching apparatus for stretching a pelt on a pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said stretching apparatus comprising:

a holding device for holding said base end of said pelt board, said stretching apparatus defining a pelt board space extending outwardly along a longitudinal direction from said holding device for accommodating said pelt board, and a fastening device, said fastening device comprise a first gripping mechanism for fastening said rear end of said pelt along either said back side contour or said leg side contour, and a second gripping mechanism for fastening said rear end of said pelt along either said leg side contour or said back side contour, respectively, said first gripping mechanism and said second gripping mechanism being movable in said longitudinal direction and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.

2. The stretching apparatus according to point 1, wherein said first gripping mechanism fastens said rear end of said pelt along said back side contour and said second gripping mechanism fastens said rear end of said pelt along said leg side contour.

3. The stretching apparatus according to any of the preceding points, wherein said first gripping mechanism and/or said second gripping mechanism comprises a gripping element and an opposite holding element, said gripping element being movable in relation to said holding element in order to pin said rear end of said pelt between said gripping element and said holding element.

4. The stretching apparatus according to any of the preceding points, wherein said second gripping mechanism comprise a first half part and a second half part, each half part being adapted for gripping approximately a quarter of said contour.

5. The stretching apparatus according to point 4, wherein when in said first position, said first half part and a second half part are located on opposite sides of said pelt board space.

6. The stretching apparatus according to any of the preceding points, wherein the movement between said first position and said second position involves a linear movement and a rotational movement of said second gripping mechanism.

7. The stretching apparatus according to any of the preceding points, wherein said holding device and/or said fastening device comprises a vibration actuator for inducing an oscillation onto said pelt.

8. The stretching apparatus according to point 7, wherein said vibration actuator operates at a frequency of between 1 Hz and 100 Hz.

9. The stretching apparatus according to any of the preceding points, wherein said stretching apparatus further comprises a holding bag applicator.

10. The stretching apparatus according to any of the preceding points, wherein said base end of said pelt board comprises a connecting element and said holding device comprises a locking part for locking said connecting element to said holding device.

11. The stretching apparatus according to any of the preceding points, wherein said fastening device comprises a compressed air outlet for temporarily removing any fur hair located adjacent said compressed air outlet.

12. The stretching apparatus according to any of the preceding points, wherein said holding device and/or said fastening device is movable by means of a pneumatic drive, a hydraulic drive or a spindle drive.

13. The stretching apparatus according to any of the preceding points, wherein said fastening device comprises a laser for generating a visual alignment line on said pelt.

14. A stretching apparatus for stretching a pelt on a pelt board, said pelt having a substantially tubular shape defining an inwardly oriented leather side, an outwardly oriented fur side, a nose end, a rear end and a pair of front leg cavities, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said stretching apparatus comprising:

a holding device for holding said base end of said pelt board, said stretching apparatus defining a pelt board space extending outwardly along a longitudinal direction from said holding device for accommodating said pelt board, a stretching device having a pair of stretching members, each of said stretching members being adapted for being inserted into a respective front leg cavity of said pelt, said stretching device being movable in a direction towards said holding device for stretching said pelt, and a fastening device, said fastening device comprise a first gripping mechanism for fastening said rear end of said pelt along either said back side contour or said leg side contour, and a second gripping mechanism for fastening said rear end of said pelt along either said leg side contour or said back side contour, respectively, said first gripping mechanism and said second gripping mechanism being movable in said longitudinal direction and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.

15. A method of stretching a pelt on a pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, said pelt further defining a contour constituting a leg side contour and a back side contour, said method comprising the steps of:

providing a stretching apparatus comprising a holding device and a fastening device, said fastening device comprises a first gripping mechanism and a second gripping mechanism, holding said base end of a pelt board by said holding device so that said pelt board extending outwardly along a longitudinal direction from said holding device, moving said first gripping mechanism and said second gripping mechanism along said longitudinal direction, fastening said rear end of said pelt along either said back side contour or said leg side contour by using said first gripping mechanism, moving said second gripping mechanism from an initial first position in which said first gripping mechanism and said second gripping mechanism are located on the same side of said pelt board to a second position in which said first gripping mechanism and said second gripping mechanism are located on opposite sides of said pelt board, and fastening said rear end of said pelt along either said leg side contour or said back side contour, respectively.

Fifth Set of Points Describing Features of the Invention

1. A stretching apparatus for stretching a pelt on a pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, said stretching apparatus comprising:

a holding device for holding said base end of said pelt board, and a fastening device comprise a gripping mechanism for fastening said rear end of said pelt, said fastening device further comprising a drive mechanism for moving said first fastening device relative to said holding device and for positioning said rear end of said pelt within said gripping mechanism, said gripping mechanism being controlled by a first user interface and said drive mechanism being controlled by a second user interface, said first user interface and/or said second user interface being located a distance of less than 30 cm from said gripping mechanism.

2. The stretching apparatus according to point 1, wherein said first user interface and/or said second user interface is located less than 30 cm from said gripping mechanism, preferably less than 20 cm, more preferably less than 10 cm, most preferably less than 5 cm.

3. The stretching apparatus according to any of the preceding points, wherein said first user interface and/or said second user interface comprises a proximity sensor, such as a photo detector or an IR sensor.

4. The stretching apparatus according to any of the preceding points, wherein said first user interface and/or said second user interface comprises a pressure sensor, a resistive sensor or a capacitive sensor.

5. The stretching apparatus according to any of the preceding points, wherein said second user interface comprises a first sensor for causing said drive mechanism to move said fastening device away from said holding device, and a second sensor for causing said drive mechanism to move said fastening device towards said holding device.

6. The stretching apparatus according to any of the preceding points, wherein said distance between said gripping mechanism and said holding mechanism is unobstructed and/or said stretching apparatus enables a human user to simultaneously reach both said gripping mechanism and said holding mechanism by the same hand.

7. The stretching apparatus according to any of the preceding points, wherein said holding device and/or said fastening device comprises a vibration actuator for inducing an oscillation onto said pelt.

8. The stretching apparatus according to point 7, wherein said vibration actuator operates at a frequency of between 1 Hz and 100 Hz.

9. The stretching apparatus according to any of the preceding points, wherein said stretching apparatus further comprises a holding bag applicator.

10. The stretching apparatus according to any of the preceding points, wherein said base end of said pelt board comprises a connecting element and said holding device comprising a locking part for locking said connecting element to said holding device.

11. The stretching apparatus according to any of the preceding points, wherein said fastening device comprises a compressed air outlet for temporarily removing any fur hair located adjacent said compressed air outlet.

12. The stretching apparatus according to any of the preceding points, wherein said holding device and/or said fastening device is movable by means of a pneumatic drive, a hydraulic drive or a spindle drive.

13. The stretching apparatus according to any of the preceding points, wherein said fastening device comprises opposing gripping members for gripping said pelt between said inwardly oriented leather side and said outwardly oriented fur side.

14. The stretching apparatus according to any of the preceding points, wherein said fastening device comprises a laser for generating a visual alignment line on said pelt.

15. A method of stretching a pelt on a pelt board comprising performing the steps of:

providing said pelt and said pelt board, said pelt having a substantially tubular shape defining an inwardly oriented leather side, an outwardly oriented fur side, a nose end and a rear end, said pelt board defining a top end for accommodating and fixating said nose end of said pelt, a circumferential wall for facing said inwardly oriented leather side of said of said pelt and a base end located opposite said top end, providing a stretching apparatus comprising a holding device and a fastening device, said fastening device comprising a gripping mechanism and a drive mechanism, providing a first user interface for controlling said gripping mechanism and a second user interface for controlling said drive mechanism, said first user interface and/or said second user interface being located a distance of less than 30 cm from said gripping mechanism, holding said base end of a pelt board by said holding device, moving said first fastening device relative to said holding device and positioning said rear end of said pelt within said gripping mechanism by using said second user interface, operating said gripping mechanism by using said first user interface.

Sixth Set of Points Describing Features of the Invention

1. A method of stretching a pelt on a pelt board comprising performing the steps of:

i) providing said pelt and said pelt board, said pelt having a substantially tubular shape defining an inwardly oriented leather side, an outwardly oriented fur side, a nose end, a rear end and a pair of front leg cavities, said pelt board defining a top end, a circumferential wall for facing said inwardly oriented leather side of said pelt and a base end located opposite said top end, ii) providing a stretching apparatus comprising a holding device, a fixating device, a length measuring device, and a controllable actuator having a velocity controller and a force detector, iii) holding said base end of said pelt board by said holding device, iv) positioning said pelt on said pelt board by arranging said nose end of said pelt in contact with said top end and arranging said rear end of said pelt at said base end, v) contacting said fixating device with said pelt at said rear end thereof, vi) operating said controllable actuator at a specific speed controlled by said velocity controller for causing said holding device and said fixating device to be moved relative to one another and away from one another and in doing so stretching said pelt while detecting by means of said force detector the force applied to said pelt by said controllable actuator, vii) measuring the length of said pelt by means of said length measuring device at the time a specific force constituting an empirically determined safe force has been detected or a specific force gradient constituting an empirically determined safe force gradient has been detected, and viii) registering said length and said specific force and/or said specific force gradient as a first set of coherent data.

2. A method of stretching a pelt on a pelt board according to point 1, further comprising performing the additional steps of:

ix) while continuing step vi) measuring the incremental increase of the length of said pelt measured by said length measuring device, x) measuring the force value by means of said force detector applied to said pelt for creating said incremental increase of the length of said pelt, xi) determining on the basis of the force value measured in step x) and the incremental increase of the length measured in step ix), the force gradient needed for creating the incremental increase of the length of the pelt, and xii) registering the incremental increase of the length of said pelt and/or the total length of said pelt and the force measured in step x) and/or the force gradient determined in step xi) as a second set of coherent data.

3. The method according to point 2, the method further comprising continuing repeating the steps ix)-xi) until a pre-set maximum allowable force or a pre-set maximum allowable force gradient has been reached and discontinuing operating said controllable actuator in step vi).

4. The method according to point 3 further comprising utilizing said second set of coherent data constituting sets of coherent data as forecasts for the stretching of a pelt of a specific species.

5. The method according to point 4, the method being used for stretching a pelt of a male or female mink, the length of which is to be classified according to the international classification established by Kopenhagen Fur A/S, the method further comprising the step of comparing the lengths measured in step ix) with a specific class of said pelt and on the basis of the forecasts determining whether or not further stretching of the pelt may be performed safely for reaching a further class or no further stretching is to be applied.

6. The method according to any of the preceding points, further comprising additional steps of performing steps ix)-xi) in an intermittent operation.

7. The method according to any of the preceding points, the step ix) being performed at a reduced or an increased speed controlled by said velocity controller.

Seventh Set of Points Describing Features of the Invention

1. A stretching apparatus for stretching a pelt on a pelt board, said pelt having a substantially tubular shape defining an inwardly oriented leather side, an outwardly oriented fur side, a nose end, a rear end and a back piece, said pelt board defining a top end for accommodating and fixating said nose end of said pelt, a circumferential wall for facing said inwardly oriented leather side of said of said pelt and a base end located opposite said top end, said stretching apparatus comprising:

a holding device for holding said base end of said pelt board, a fastening device for fastening said rear end of said pelt and being movable relative to said holding device for stretching said pelt, and a fur side processing tool being supported movably relative to said pelt board along said first side from a nose end positioned to a rear end position and to be returned from said rear end position to said nose end position.

2. The stretching apparatus according to claim 1, further comprising a vertical stand supporting said holding device, said fastening device and said fur side processing tool, said fur side processing tool being journaled vertically movable relative to said stand.

3. The stretching apparatus according to claim or 2, said fur side processing tool including agitator elements, such as rollers, brushes, combs or other elements for contacting the fur side of the pelt.

4. The stretching apparatus according to claim 3, said agitator elements being powered by a motor.

5. The stretching apparatus according to any of the claims 1-4, said fur side processing tool being positioned circumferentially encircling said pelt board.

6. The stretching apparatus according to any of the claims 1-4, further having any of the features of the stretching apparatus according to the points of the first set of points and/or the second set of points.

7. A method of stretching a pelt on a pelt board comprising the steps of:

providing said pelt on said pelt board, said pelt having a substantially tubular shape defining an inwardly oriented leather side and an outwardly oriented fur side, a nose end, a rear end and a back piece, said pelt board defining a top end for accommodating and fixating said nose of said pelt, a circumferential wall for facing said inwardly oriented leather side of said pelt and a base end located opposite said top end, providing a stretching apparatus comprising a holding device, a fastening device and a fur side processing tool, said holding device serving to hold said base end of said pelt board, said fastening device to fasten said rear end of said pelt, positioning said pelt on said pelt board, positioning said pelt board in said holding device prior to or after arranging said pelt on said pelt board, fastening said fastening device to said rear end of said pelt, moving said fastening device relative to said holding device for stretching said pelt and prior to or after said stretching of said pelt, moving said fur side processing tool along the fur side of said pelt from a nose end position to a rear end position and returning said processing tool from said rear end position to said nose end position.

8. The method according to claim 6, further having any of the features of the points according to the first set of points and/or the second set of points.

The invention claimed is:

1. A stretching apparatus for use with a pelt board to stretch a pelt on said pelt board, wherein the pelt to be stretched has an inwardly oriented leather side, an outwardly oriented fur side, a nose end, a rear end, and first and second front leg cavities, said pelt board defining a top end configured for accommodating and fixating said nose end of said pelt, and a base end located opposite said top end, said stretching apparatus comprising:

a holding device configured for holding said base end of said pelt board; and a stretching device comprising first and second stretching members, said first stretching member being a first pin configured for being inserted into said first front leg cavity of said pelt, and said second stretching member being a second pin configured for being inserted into said second front leg cavity of said pelt, said stretching device being movable in a direction towards said holding device for stretching said pelt.

2. The stretching apparatus according to claim 1, wherein each of said first and second pins is cylindrical.

3. The stretching apparatus according to claim 1, wherein said apparatus further comprises a first fastening device configured for fastening said rear end of said pelt, said first fastening device being movable in a direction towards said holding device for stretching said pelt.

4. The stretching apparatus according to claim 3, wherein said apparatus further comprises a second fastening device configured for fastening a tail part extending from said rear end of said pelt, said second fastening device being movable in a direction towards said holding device for stretching said pelt.

5. The stretching apparatus according to claim 4, wherein said apparatus further comprises a third fastening device configured for fastening and fixating said nose end of said pelt, said third fastening device being movable in a direction towards said holding device for stretching said pelt.

6. The stretching apparatus according to claim 5, wherein at least one of said stretching device, said first fastening device, said second fastening device, and said third fastening device is movable by means of a drive mechanism selected from the group consisting of a pneumatic drive, a hydraulic drive, an electric drive, and a spindle drive.

7. The stretching apparatus according to claim 3, wherein said first fastening device comprises opposing gripping members configured for gripping said pelt between said inwardly oriented leather side and said outwardly oriented fur side.

8. The stretching apparatus according to claim 1, wherein said pair of stretching members are interconnected by a rack and pinion actuator.

9. A stretching apparatus for use with a pelt board to stretch a pelt on said pelt board, wherein the pelt to be stretched has an inwardly oriented leather side, an outwardly oriented fur side, a nose end, a rear end, and first and second front leg cavities, said pelt board defining a top end configured for accommodating and fixating said nose end of said pelt, and a base end located opposite said top end, said pelt further defining a contour constituting a leg side contour and a back side contour, said stretching apparatus comprising:

a holding device configured for holding said base end of said pelt board, said stretching apparatus defining a pelt board space extending outwardly along a longitudinal direction from said holding device for accommodating said pelt board;

a stretching device comprising first and second stretching members, said first stretching member being configured for being inserted into said first front leg cavity of said pelt, and said second stretching member being configured for being inserted into said second front leg cavity of said pelt, said stretching device being movable in a direction towards said holding device for stretching said pelt; and a fastening device, comprising a first gripping mechanism configured for fastening said rear end of said pelt along either one of said back side contour and said leg side contour, and a second gripping mechanism configured for fastening said rear end of said pelt along one of said leg side contour and said back side contour, respectively, said first gripping mechanism and said second gripping mechanism being movable in said longitudinal direction, and said second gripping mechanism additionally being movable between a first position in which said first gripping mechanism and said second gripping mechanism are located on the same side of said pelt board space, and a second position in which said first gripping mechanism and said second gripping mechanism are located on opposite sides of said pelt board space.

10. A method of stretching a pelt on a pelt board, wherein the pelt has an inwardly oriented leather side, an outwardly oriented fur side, a nose end, a rear end, and first and second front leg cavities, and wherein the pelt board defines a top end configured to accommodate and fix the nose end of the pelt, and a base end located opposite the top end, the method comprising the steps of:

providing a stretching apparatus comprising a holding device and a stretching device, the stretching device having first and second stretching members;

holding the base end of the pelt board by the holding device;

inserting the first stretching member of the stretching device into the first front leg cavity of the pelt, and inserting the second stretching member of the stretching device into the second front leg cavity of the pelt; and moving the stretching device in a direction towards the holding device, thereby stretching the pelt.

* * * * *